US006595094B1

(12) United States Patent
Kondo et al.

(10) Patent No.: US 6,595,094 B1
(45) Date of Patent: Jul. 22, 2003

(54) WORKING CUTTING APPARATUS AND METHOD FOR CUTTING WORK

(75) Inventors: Sadahiko Kondo, Takarazuka (JP); Toshiaki Sasaki, Nagaokakyo (JP); Masanori Chikuba, Saga (JP); Toshifumi Hiyoke, Muko (JP); Sajio Ozaki, Toyonaka (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/494,124

(22) Filed: Jan. 28, 2000

(30) Foreign Application Priority Data

Jan. 29, 1999 (JP) ..... 11-021811
Jan. 29, 1999 (JP) ..... 11-021819

(51) Int. Cl.[7] ..... B26D 1/00
(52) U.S. Cl. ..... 83/471.2; 83/488; 83/698.51
(58) Field of Search ..... 83/483, 484, 485, 83/487, 488, 489, 471.2, 471, 508.3, 646, 696.51, 425.3, 425.4; 125/13.01, 15, 16.01, 18

(56) References Cited

U.S. PATENT DOCUMENTS 1,230,696 A * 6/1917 Filotico ..... 125/13.01
1,347,365 A * 7/1920 Fletcher ..... 125/18
1,505,367 A * 8/1924 Biersdorf ..... 83/471.2
1,782,894 A * 11/1930 Grueter ..... 83/481
2,254,046 A * 8/1941 Pearson ..... 125/13.01
2,377,437 A * 6/1945 Martin ..... 125/13.01
2,511,962 A * 6/1950 Barnes ..... 125/13.01
2,698,661 A * 1/1955 MacQuarrie ..... 83/446
3,430,714 A * 3/1969 Brieger ..... 125/15
3,834,258 A * 9/1974 Zumstein ..... 83/425.4
4,014,234 A * 3/1977 Spengler ..... 83/698.51
4,522,097 A * 6/1985 Adlon et al. ..... 83/471.2
4,738,573 A * 4/1988 Johnson, Jr. ..... 83/471.3
4,911,047 A * 3/1990 Hornung et al. ..... 83/342
5,373,766 A * 12/1994 Ranly et al. ..... 83/698.41
5,761,980 A * 6/1998 Ima et al. ..... 83/508.3

FOREIGN PATENT DOCUMENTS

| | | |
|---|---|---|
| JP | 47-36633 | 11/1972 |
| JP | 53-95384 | 8/1978 |
| JP | 55-175055 | 12/1980 |
| JP | 56-151753 | 11/1981 |
| JP | 63-197047 | 12/1988 |
| JP | 1-301050 | 12/1989 |
| JP | 8-5013 | 10/1991 |
| JP | 2719218 | 12/1991 |
| JP | 4-46800 | 2/1992 |
| JP | 6-47662 | 2/1994 |
| JP | 9-17441 | 7/1997 |
| JP | 10-29116 | 2/1998 |
| JP | 10-202500 | 8/1998 |
| JP | 10-202649 | 8/1998 |

OTHER PUBLICATIONS

Notification of Reasons for Refusal to the corresponding Japanese Patent Application No. 11–021819 (and translation thereof 4 pgs.).

* cited by examiner

*Primary Examiner*—Allan N. Shoap
*Assistant Examiner*—Stephen Choi
(74) *Attorney, Agent, or Firm*—Armstrong, Westerman & Hattori, LLP.

(57) ABSTRACT

A work cutting apparatus comprises a bed. The bed has an upper surface provided with a column including a rail slidably mounted with a slider. The slider has a front surface mounted with a supporting portion supporting two end portions of a rotating shaft. The rotating shaft is mounted with a plurality of cutting blade blocks. Each of the cutting blade blocks includes a plurality of cutting blades and a thicker cutting blade at each end of the cutting blade block. A table provided with a recess having a V-shaped section is disposed on the bed right beneath the cutting blade blocks. A plurality of works are disposed in the recess, each fixed by a fixing member. The cutting blades lowered while rotating, thereby cutting the works. During this operation, coolant is discharged from a plurality of supplying ports of a coolant supplying portion as well as from a supplying port of a coolant supplying path.

2 Claims, 24 Drawing Sheets

Stroke in Z-feed

Upon start of cutting

During cutting(latter phase)

Upon start of cutting

During cutting(latter phase)

FIG. 18A
Comparison in Cutting Accuracy
| | Dimensional Inconsistency(mm) | Parallelism(mm) |
|---|---|---|
| Case in Figs.16A,16B:First time | 0.199 | 0.024 |
| :Second time | 0.178 | 0.022 |
| Case in Figs.15A,15B:First time | 0.175 | 0.024 |
| :Second time | 0.138 | 0.024 |
| :Third time | 0.097 | 0.021 |
FIG. 18B
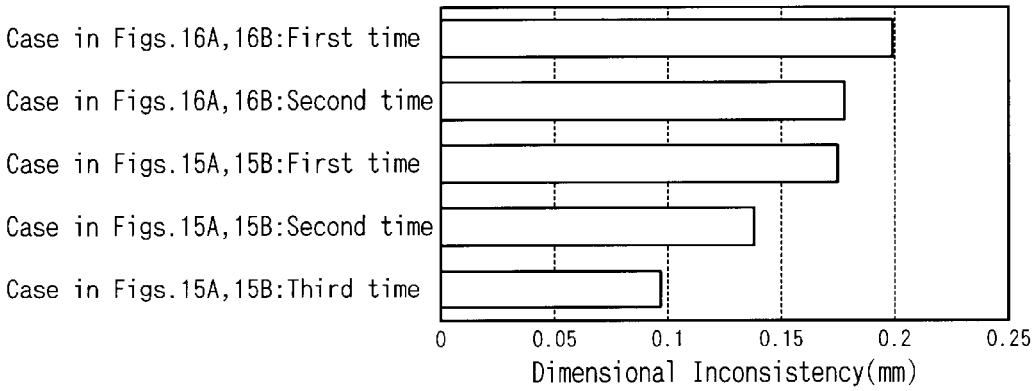
FIG. 18C
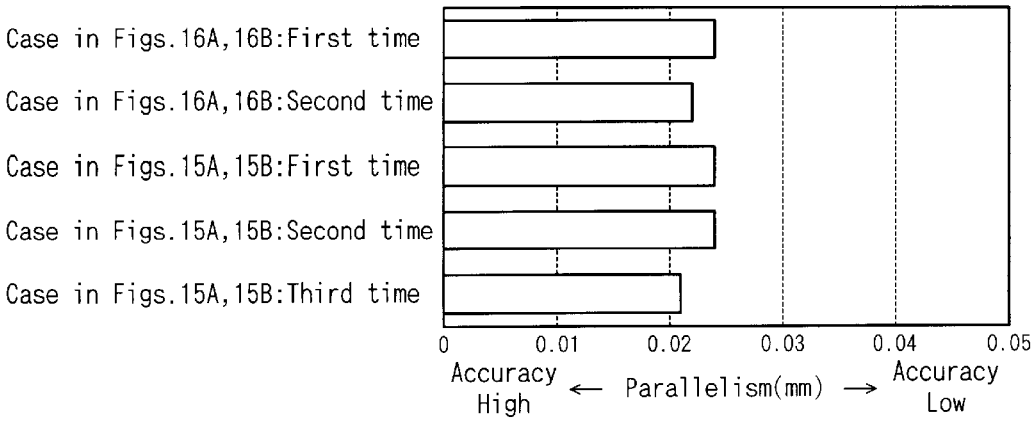

Comparison in Cutting Blade Life

| | Abrasion Rate (Radius lost per 100 passes: mm/100passes) |
|---|---|
| Case in Figs.16A,16B:First time | 0.19 |
| :Second time | 0.17 |
| Case in Figs.15A,15B:First time | 0.13 |
| :Second time | 0.13 |
| :Third time | 0.13 |

Conventional (X-feed) Stroke

WORKING CUTTING APPARATUS AND METHOD FOR CUTTING WORK

BACKGROUND OF THE INVENTION

1. Field of the Invention

The present invention relates to a work cutting apparatus and a method for cutting a work, and specifically to a work cutting apparatus and a method for cutting a sintered compact such as a magnet.

2. Description of the Related Art

FIG. 22 shows a conventional work cutting apparatus for obtaining a magnet used in a voice coil motor for example. This work cutting apparatus 1 is an overhang model of a so-called cantilever type. A rotating shaft 2 is mounted with a plurality of cutting blades 3 spaced from each other by spacers (not illustrated). The rotating shaft 2 has an end portion supported by a support arm 4. The work cutting apparatus 1 includes an X-slider 6 slidably placed on rails 5. The X-slider 6 has an upper surface provided with a chuck table 7. The chuck table 7 has an upper surface provided with a pasting board 8. The pasting board 8 has an upper surface placed for example with a plurality of works 9 fixed by an adhesive. Then, the X-slider 6 is slid in a direction shown by an arrow A (along an X axis), so that the works 9 are moved at a constant speed toward the cutting blades 3 rotating in a direction shown by an arrow B, thereby cutting the works 9 into a predetermined thickness. Since the works 9 are cut by the plurality of cutting blades 3, a plurality of magnet pieces are obtained in a single cycle of cutting operation.

In the work cutting apparatus 1, the cutting blades 3 should ideally be mounted at exact right angle to the rotating shaft 2. In such a case, a cutting reaction will only develop within surfaces of the cutting blades, or no force causing the cutting blade 3 to deform vertically to a rotating plane of the cutting blade 3 is generated. Actually however, as shown in FIG. 23, there is involved a cutting blade mounting error $\theta$ ($\theta$=0.02–0.04 degree approx.), and therefore the cutting reaction f. The cutting reaction f includes a tangential component force f1, which includes a component force f2 corresponding to the mounting error ($f2=f1\times\sin\theta$) acting as the force to deform the cutting blade 3. As a result, the cutting blade 3 is deformed, and cutting accuracy is reduced.

Further, according to the convention, as shown in FIG. 24, a stroke L2 of the cutting blade 3 necessary for the cutting is long, and therefore a long time is required for the cutting operation, posing a problem of poor operability.

SUMMARY OF THE INVENTION

It is therefore a primary object of the present invention to provide a work cutting apparatus and a method for cutting a work capable of improving the cutting accuracy and productivity.

According to an aspect of the present invention, there is provided a work cutting apparatus for cutting a work by rotation of a cutting blade, comprising: a first driving portion rotating the cutting blade, and a second driving portion moving at least either one of the cutting blade and the work relative to the other in the vertical direction when cutting.

According to another aspect of the present invention, there is provided a method for cutting a work, comprising: a first step of placing the work at a predetermined position; a second step of preparing a cutting blade; and a third step of rotating the cutting blade, moving at least either one of the cutting blade and the work relative to the other in the vertical direction, whereby cutting the work with the cutting blade.

According to the present invention, by a cutting through lowering the rotating cutting blade for example down to the work disposed at a predetermined position, it becomes possible to reduce the force that deforms the cutting blade than in the convention. Thus, load acting on the cutting blade becomes smaller, deformation of the cutting blade becomes smaller, resulting in improved accuracy of a cut surface. Further, since a stroke of the cutting blade necessary for the cutting can also be reduced, cutting time can be reduced, and productivity is improved.

According to still another aspect of the present invention, there is provided a work cutting apparatus for cutting a work by rotation of a cutting blade, comprising: a first driving portion rotating the cutting blade, and a second driving portion moving at least either one of the cutting blade and the work relative to the other along a normal line passing the point of contact between the cutting blade and the work when cutting.

According to another aspect of the present invention, there is provided a method for cutting a work, comprising: a first step of placing the work at a predetermined position; a second step of preparing a cutting blade; and a third step of rotating the cutting blade, moving at least either one of the cutting blade and the work relative to the other along a normal line passing the point of contact between the cutting blade, whereby cutting the work with the cutting blade.

In this case again, in which the cutting is made along a normal line passing the point of contact between the rotating cutting blade and the work disposed at a predetermined position, the load to the cutting blade becomes smaller. Therefore, deformation of the cutting blade becomes smaller, resulting in improved accuracy of the cut surface. Further, since the stroke of the cutting blade necessary for the cutting can also be reduced, the cutting time can be reduced, and productivity is improved.

According to the present invention, preferably, the cutting blade is mounted to a rotating shaft, and the rotating shaft has two end portions supported by a supporting portion mounted to a unit. By supporting at both end portions of the rotating shaft, it becomes possible to hold the cutting blade more stably, thereby reducing the deflection of the cutting blade during the cutting operation. Therefore, when cutting a brittle work such as a sintered compact, chipping can be reduced, and cutting accuracy can be improved. Further, since the deflection of the cutting blade can be reduced, the number of cutting blades to be mounted to the rotating shaft can be increased. As a result, the number of pieces obtained by a single cutting operation can be increased, and therefore productivity can be increased. Further, since the supporting portion supporting both end portions of the rotating shaft is mounted to one unit, holding accuracy of the cutting blade, particularly horizontal accuracy can be improved.

Further, preferably, the supporting portion includes a first supporting portion and a second supporting portion respectively supporting the two end portions of the rotating shaft. The first supporting portion is mounted movably to the second supporting portion.

Further, preferably, the rotating portion includes an arbor having two tapered end portions, and rotation supporting portions each having a receiving portion mated with one of the tapered end portions of the arbor. By forming the taper at each end portion of the arbor of the rotating shaft, and by mating each tapered end portion to the receiving portion, fixing accuracy of the cutting blade can be improved.

Further, preferably, the first driving portion includes a belt for rotating the cutting blade by belt transmission, and a tension adjusting portion for adjusting tension of the belt. By maintaining the tension of the belt always at a constant level by the tension adjusting portion, slippage of the belt can be prevented, and rotation of the belt can be stabilized. This is particularly effective in an arrangement in which the cutting is made by moving the cutting blade toward the work.

According to the present invention, preferably, a plurality of works are disposed on a recess of a work disposing portion. With such an arrangement, a large number of works can be cut at one time.

Further, preferably, the recess has a V-shaped section in at least either one of a plane including the cutting blade and a plane parallel thereto. By making the recess to have the V-shaped section, cost of machining the work disposing portion can be reduced, and applicability to a variety of kinds of works is achieved. Especially, a plate-like work can be positioned stably without rattling.

Further, preferably, the cutting blade include a disc-like substrate having a Young's modulus of 441,315 $N/mm^2$~686,490 $N/mm^2$, and a cutting edge formed in an outer circumference of the substrate. By using a super hard metal for example, having the Young's modulus of 441,315 $N/mm^2$~686,490 $N/mm^2$, as the substrate of the cutting blade, a cutting blade which is thin, hard and cuts well can be obtained. Therefore, margin allowed for the cutting blade can be narrowed, yield of products can be improved, and productivity can be improved.

Preferably, the apparatus further comprises a fixing member for fixing the work to the recess. The fixing member has a comb-like portion pressed to a surface of the work facing the cutting blade. According to this arrangement, since the work is fixed by the comb-like portion pressed from above to the surface of the work facing the cutting blade, differing from the convention, there is no need for bonding the work by adhesive and so on or un-bonding the adhesive after the work is cut, leading to reduced operation time and improved productivity.

Further, preferably, a plurality of the cutting blades are included into a cutting blade block. The cutting blade block have two end portions each mounted with a cutting blade having a thickness greater than a thickness of the other cutting blades. By increasing the thickness of the cutting blades at the ends, each end margin of the work potentially becoming a dimensionally inferior product can be ground into dust. Therefore, inclusion of the inferior products can be prevented, and yield and productivity can be improved.

Further, preferably, a plurality of cutting blade blocks are mounted axially thereof. According to this arrangement, a mounting error in each of the cutting blades will not adversely affect adjacent cutting blade blocks, or the error will not accumulate. Therefore, a plurality of cutting blade blocks can be axially disposed, and as a result, a greater number of works can be cut in a single cutting operation. Further, since the cutting blade block can be set for each of the works, mounting accuracy of the cutting blade can be improved, and inclusion of dimensionally inferior products can be reduced. Therefore, yield is increased, and productivity is improved.

According to the present invention, preferably, the apparatus further comprises a first coolant supplying portion including a first supplying port and a second supplying port each supplying a coolant to the works. By providing the first supplying port and the second supplying port each discharging the coolant from a position different from the other, thereby supplying the coolant to the works from the plurality of locations, the coolant can be supplied reliably even if the work disposing portion having the recess is used and the cutting blade has an increased area of contact with the works. Therefore, the cutting blade can be abraded efficiently, making possible to cut the works productively.

Further, preferably, the first supplying port is formed near the works, whereas the second supplying port is formed on an upstream side of rotation of the cutting blade than is the first supplying port. According to this arrangement, since the coolant is supplied to the cutting blade and the works from the same side thereof and from the plurality of locations, sludge can be discharged smoothly.

Further, preferably, the plurality of works are disposed on an upstream side and an downstream side of the rotation of the cutting blade, and the coolant from the second supplying port is directed toward the work on the downstream side of rotation of the cutting blade. According to this arrangement, the coolant can be supplied also to the work located on the downstream side of rotation of the cutting blade. Further, the coolant from the second supplying port interrupts an accompanying stream of air which follows the turning of the cutting blade. Therefore, the coolant from the first supply port becomes less affected by the accompanying stream of air, and therefore the coolant from the first supplying port can be supplied more reliably to the works.

Preferably, the apparatus further comprises a second coolant supplying portion including a supplying port formed in the recess for supplying the coolant. According to this arrangement, the coolant can be supplied to portions where the first coolant supplying portion can not efficiently supply the coolant such as a side surface of the work. Thus, cutting accuracy of the work is improved further. This arrangement is especially effective if the work has a large thickness.

Further, preferably, the apparatus further comprises an enclosing member enclosing the recess. According to this arrangement, it becomes possible to hold the coolant in the recess. Thus, the work can be cut while the work is being bathed in the coolant. Thus, the cutting accuracy of the work can be further improved.

Further, preferably, the cutting blade includes resin-bound diamond. If the cutting blade includes resin-bound diamond, insufficient amount of supply of the coolant will cause abnormal friction in the cutting blade, deteriorating the cutting accuracy. Thus, the present invention is especially effective.

Preferably, a discharge pressure of the coolant is 196,140 Pa~471,050 Pa. According to this arrangement, the cutting blade including the resin-bound diamond can be abraded efficiently, making possible to cut the work smoothly.

The object described above, other objects, features, aspects and advantages of the present invention will become clearer from description of embodiments to be made hereinafter with reference to the attached drawings.

BRIEF DESCRIPTION OF THE DRAWINGS

FIGS. 18A is a table showing results of an experiment on a cutting accuracy, whereas FIGS. 18B and 18C are graphical representations of the results;

FIG. 19A is a table showing results of an experiment on the life of a cutting blade, whereas FIG. 19B is a graphical representation of the results;

DETAILED DESCRIPTION OF THE PREFERRED EMBODIMENTS

Figure 1:
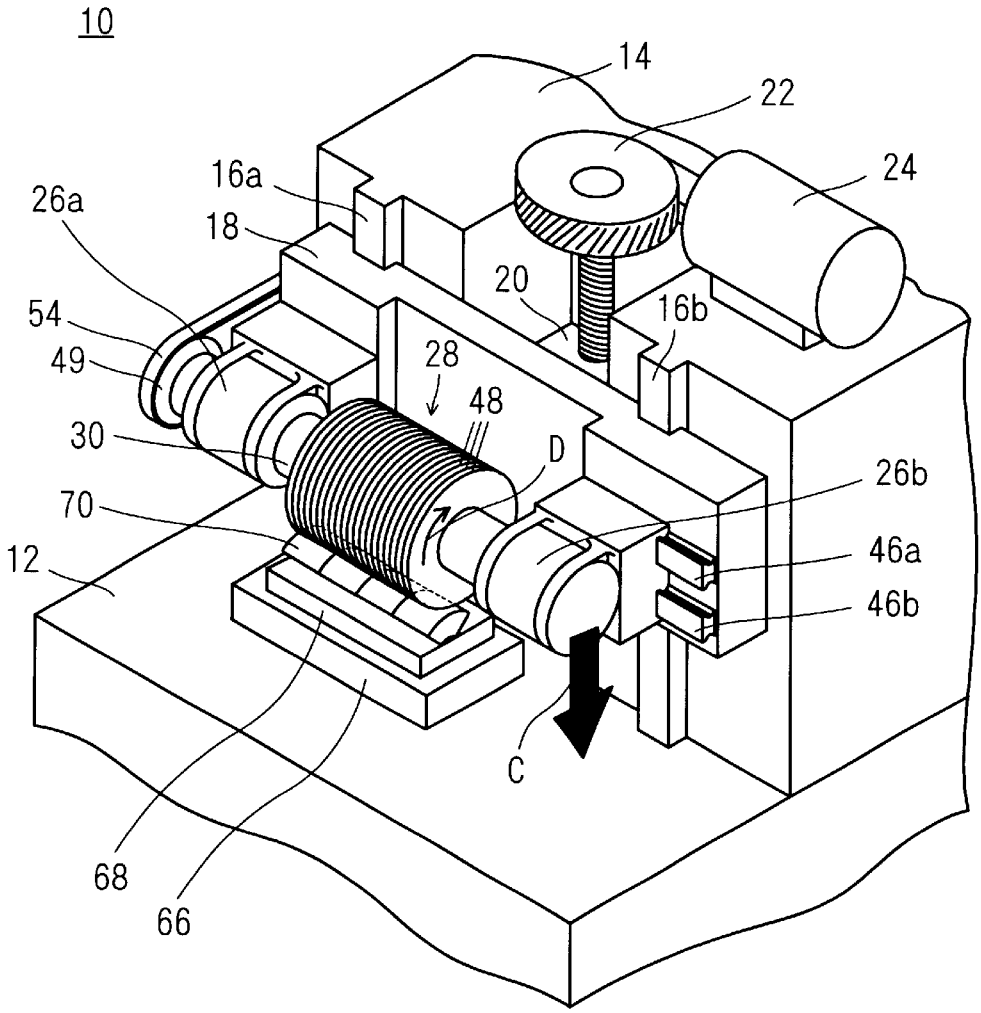
FIG. 1 is a perspective view showing a primary portion of an embodiment of the present invention.
Figure 2:
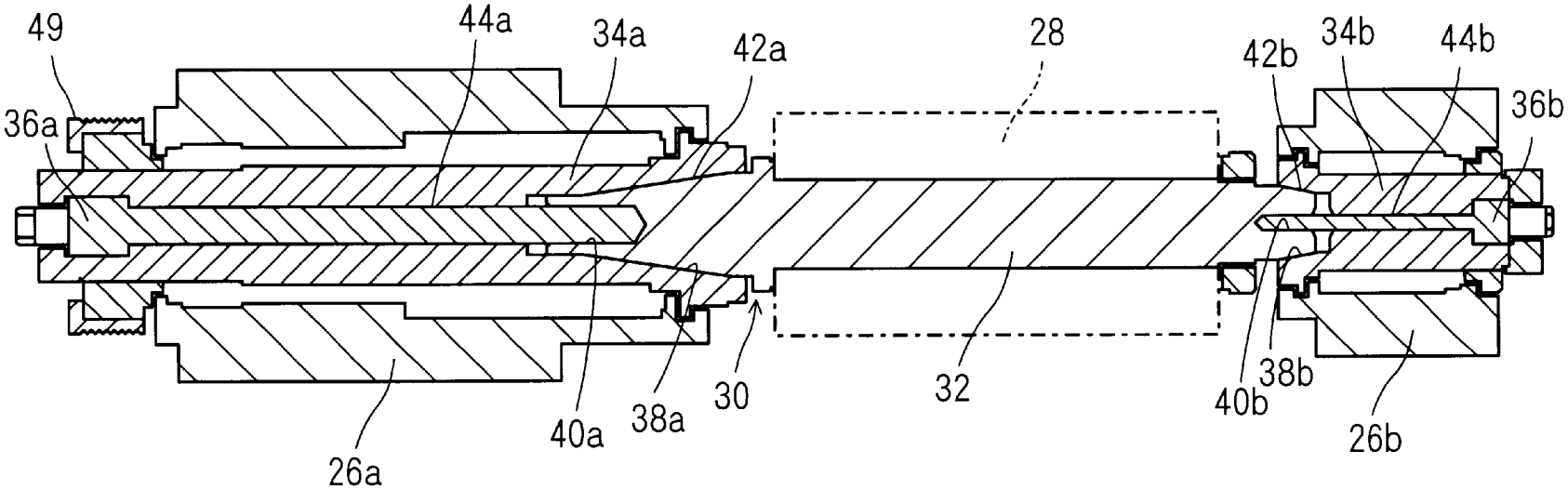
FIG. 2 is a perspective view showing a primary portion of a supporting portion and a rotating shaft.

Hereinafter, embodiments of the present invention will be described with reference to the attached drawings. Referring to FIG. 1, a work cutting apparatus 10 as an embodiment of the present invention is a portal thin-bladed double-end-supported cutting apparatus, and comprises a bed 12. The bed 12 has an upper surface provided with a column 14 having a generally U-shaped cross section. The column 14 has a front surface formed with a pair of rails 16*a*, 16*b* parallel to each other, running in the vertical direction. The pair of rails 16*a*, 16*b* guide a slider 18 which is slidable in vertical directions (along a Z axis). The slider 18 has a back surface provided with a slider supporting portion 20 formed with a vertical threaded hole. The threaded hole of the slider supporting portion 20 is threaded by a screw 22 serving as a feeding shaft for cutting. The screw 22 is rotated by a lifting motor 24 disposed on the column 14. Therefore, the lifting motor 24 controls turning of the screw 22, thereby vertically moving the slider 18 via the slider supporting portion 20. When cutting, a block of cutting blades 28 to be described later is fed in a direction of arrow C (downward direction). The slider 18 has a front surface formed with supporting portions 26*a*, 26*b* each positioned at a same height, being spaced from the other by a predetermined distance. The supporting portions 26*a*, 26*b* support two end portions of a rotating shaft 30 mounted with the cutting blade block 28. As shown in FIG. 2, the rotating shaft 30 includes an arbor 32, rotation supporting portions 34*a*, 34*b*, and screws 36*a*, 36*b*. The arbor 32 has two end portions respectively formed with tapered portions 38*a*, 38*b*, and has two tip portions respectively formed with threaded holes 40*a*, 40*b*. The rotation supporting portions 34*a*, 34*b*respectively have receiving portions 42*a*, 42*b* for receiving end portions of the arbor 32, and threaded holes 44*a*, 44*b* for receiving the screws 36*a*, 36*b*. The receiving portions 42*a*, 42*b* are respectively tapered to fit the tapered portions 38*a*, 38*b*.

Therefore, according to the rotating shaft 30, the receiving portions 42*a*, 42*b* are respectively fitted by the tapered portions 38*a*, 38*b*, integrating the rotation supporting portions 34*a*, 34*b* with the arbor 32. Further, the screw 36*a* is inserted into the threaded hole 44*a* and threaded into the threaded hole 40*a*, as well as the screw 36*b* is inserted into the threaded hole 44*b* and threaded into the threaded hole 40*b*. With the above arrangement, the arbor 32 is fixed accurately.

With the above constitution, the rotating shaft 30 is supported by the supporting portions 26*a*, 26*b*, with unillustrated bearings interposed respectively between the supporting portion 26*a* and the rotation supporting portion 34*a*, and between the supporting portion 26*b* and the rotation supporting portion 34*b*. Thus, the rotating shaft 30 is rotatably supported.

It should be noted here that as shown in FIG. 1, the supporting portion 26*b* is slid in a pair of rails 46*a*, 46*b* provided in the slider 18, detachably mounted to the front surface of the slider 18, thereby making the rotating shaft 30 detachable. Further, the cutting blade block 28 has a plurality of cutting blades 48. The cutting blades 48 are interposed by spacers (not illustrated). According to the present embodiment, the cutting blade 48 has, for example, a thickness of 0.6 mm, with the spacer having a thickness of 2.5 mm.

Figure 3:
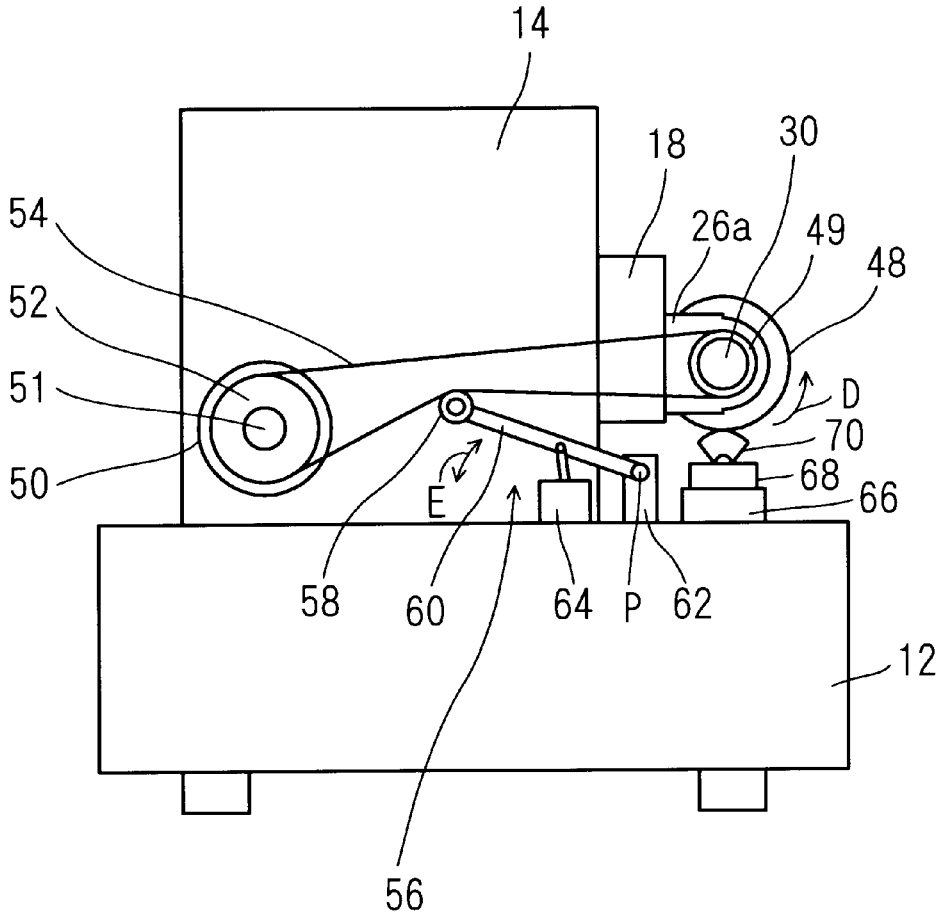
FIG. 3 is a side view showing a primary portion of the embodiment in FIG. 1.

Referring also to FIG. 3, the rotating shaft 30 has an end portion mounted with a pulley 49. A rotating shaft motor 50 rotates a rotating shaft 51 mounted with a motor pulley 52. The pulley 49 and the motor pulley 52 are connected by a belt 54 for belt transmission. The belt 54 driven by the rotating shaft motor 50 rotates the rotating shaft 30 and the cutting blade block 28 in a direction shown by an arrow D for example. Attention should be paid here to provision of a tension adjusting portion 56 for adjustment of tension of the belt 54. The tension adjusting portion 56 includes a pivotal shaft 60 having an end formed with a pulley 58, a supporting portion 62 supporting the pivotal shaft 60 and an air cylinder 64. The pulley 58 at the end of the pivotal shaft 60 is rotated by the belt 54. The air cylinder 64 presses the pivotal shaft 60 pivoting in directions shown by arrow E around a pivotal center P, so that the pivotal shaft 60 pushes the belt 54 by a constant force. Thus, the tension of the belt 54 can be maintained at a constant level.

Returning to FIG. 1, a table 66, made of stainless steel for example, is provided on the bed 12 right below the cutting blade block 28. The table 66 has an upper surface disposed with a pasting board 68 made of carbon for example. The pasting board 68 has an upper surface for placement with works 70 fixed by an adhesive for example. According to the present embodiment, a total of four works 70 are disposed longitudinally in a row. The works 70 are sintered compacts or magnetic members such as magnets each having an arcuate surface.

Now, main actions of the work cutting apparatus 10 will be described.

First, the works 70 are fixed to the pasting board 68 by an adhesive for example. The pasting board 68 fixed with the works 70 is then set to the table 66. Then, a start button (not illustrated) is pressed, whereupon the cutting blades 48 begin rotating and lowering toward the works 70, commencing a cutting. When the works 70 have been cut, the cutting blades 48 are raised, and if the cutting operation is to be ceased, then the rotation of the cutting blades 48 is stopped.

Figure 4:
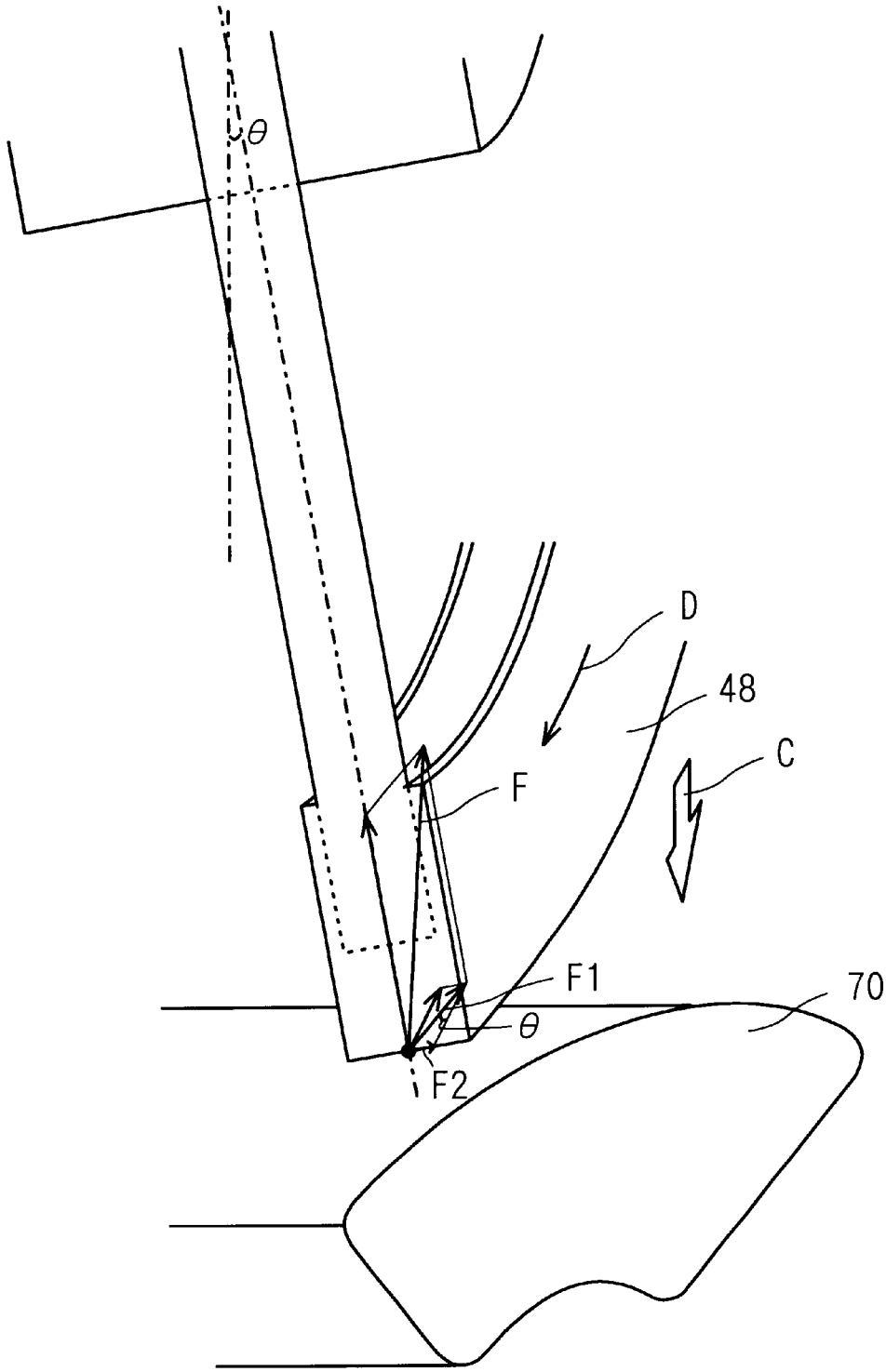
FIG. 4 is a conceptual diagram showing relationships in reaction forces acting on a cutting blade during a cutting operation according to the embodiment shown in FIG. 1.

According to the work cutting apparatus 10 as described above, even if the cutting blade mounting error θ is as large as in the convention, a tangential component force F1 becomes smaller as shown in FIG. 4 because the cutting reaction F acts generally toward the center of the rotating shaft 30. Inevitably therefore, a component force F2 (=F1× sin θ) which deforms the cutting blade 48 becomes smaller than in the convention shown in FIG. 23, reducing a load acting on the cutting blade 48. As a result, it becomes possible to reduce deformation of the cutting blade 48 and deflection of the cutting blade 48, resulting in improvement in cutting accuracy.

Figure 5:
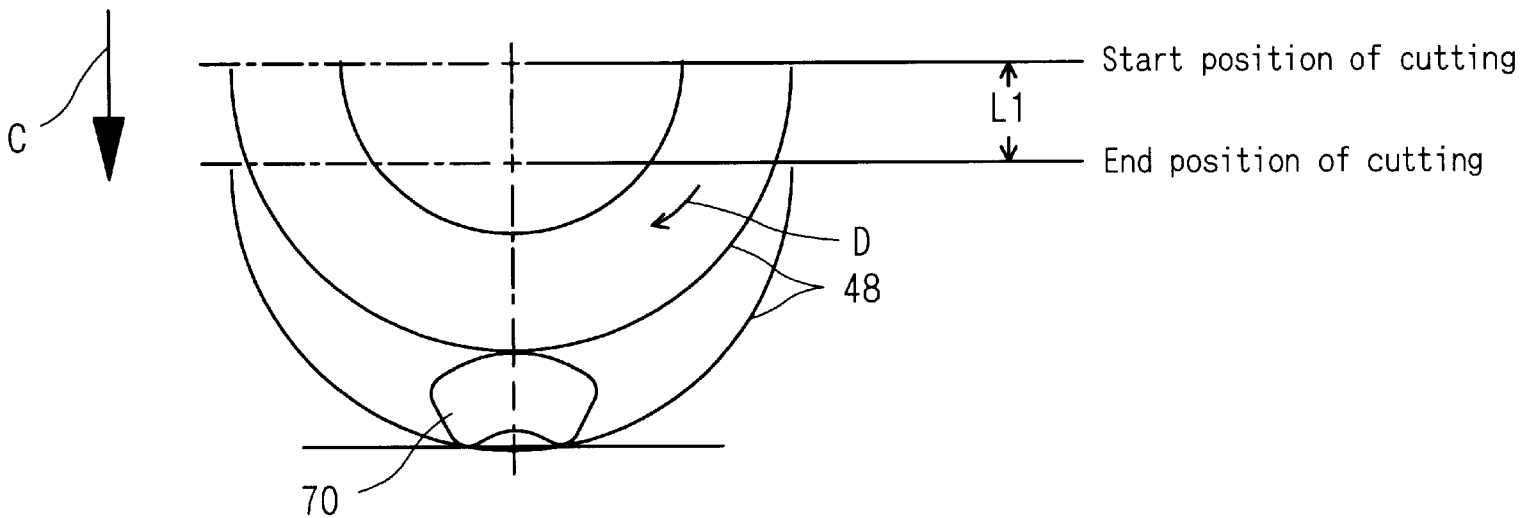
FIG. 5 is a conceptual diagram showing a cutting stroke according to the embodiment shown in FIG. 1.
Figure 6:
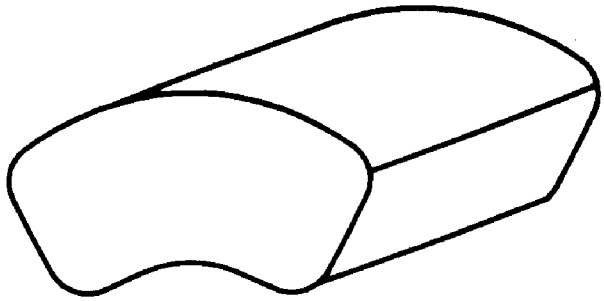
FIG. 6 PRIOR ART
FIG. 6 is a perspective view showing a work.
Figure 24:
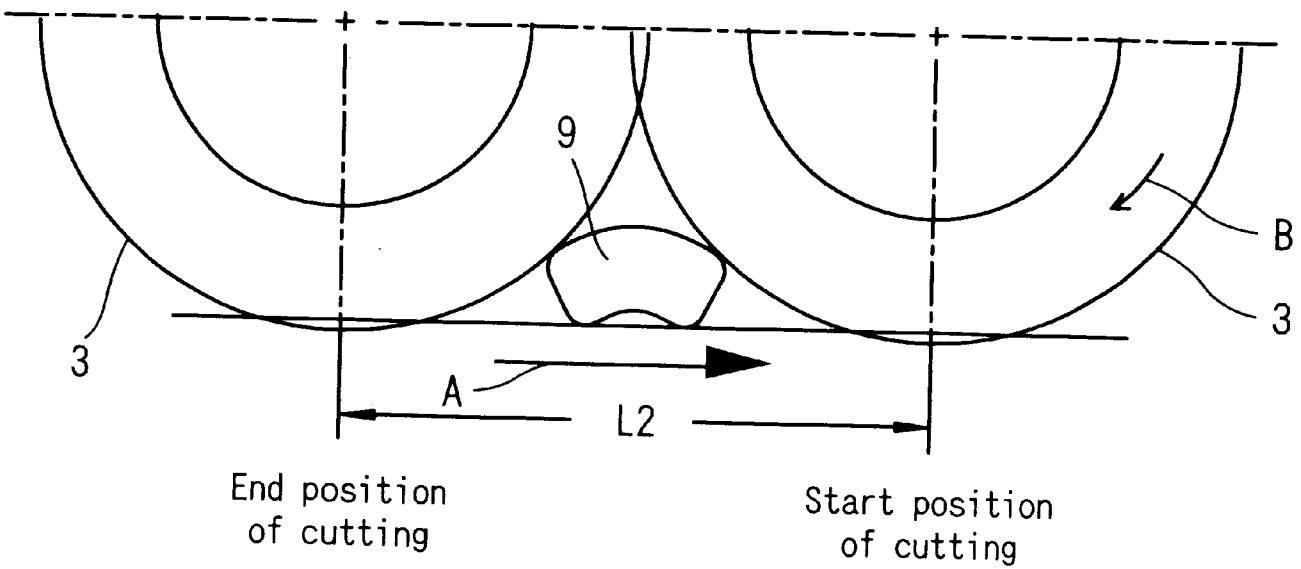
FIG. 24 PRIOR ART
FIG. 24 is a conceptual diagram showing a cutting stroke according to the conventional art shown in FIG. 22.

Further, as shown in FIG. 5, a stroke L1 of the cutting blade 48 from a start position of cutting to an end position of the cutting by the work cutting apparatus 10 can be shortened as compared to a stroke L2 of the convention shown in FIG. 24. Specifically, the cutting stroke can be shortened and work cutting time can be reduced remarkably by cutting from above. As an experiment, an arcuate neodymium magnet (U.S. Pat. No. 4,770,723) shown in FIG. 6 was cut. The work cutting time by the conventional work cutting apparatus 1 was 18.5 minutes. However, the time was reduced to 14.5 minutes by the work cutting apparatus 10.

Further, by adopting so-called double-end support construction in which both end portions of the rotating shaft 30 are respectively supported by the supporting portions 26*a*, 26*b*, it becomes possible to hold the cutting blades 48 more stably, thereby reducing the deflection of the cutting blades 48 during the cutting operation. Therefore, when cutting a brittle work such as a sintered compact, chipping can be reduced, and cutting accuracy can be improved. Further, since the deflection of the cutting blades 48 can be reduced, the number of cutting blades 48 to be mounted to the rotating shaft 30 can be increased. As a result, the number of pieces obtained by a single cutting operation can be increased, and therefore productivity can be increased.

Supporting portions 26*a*, 26*b* supporting the end portions of the rotating shaft 30 are both mounted to a single unit, i.e. the slider 18. Therefore, holding accuracy of the cutting blades 48, particularly horizontal accuracy can be improved.

Further, the two end portions of the arbor 32 of the rotating shaft 30 are formed with the tapered portions 38*a*, 38*b* respectively, and these tapered portions 38*a*, 38*b* are respectively fitted into the receiving portions 42*a*, 42*b* of the rotation supporting portions 34*a*, 34*b*. This makes possible to improve fixing accuracy of the cutting blades 48.

Further, the tension adjusting portion 56 always maintains the tension of the belt 54 at a constant level. This prevents slippage of the belt 54, making possible to stabilize rotation of the belt 54. This is particularly effective in such an arrangement as in the present embodiment in which the cutting blades 48 are moved vertically.

Figure 7:
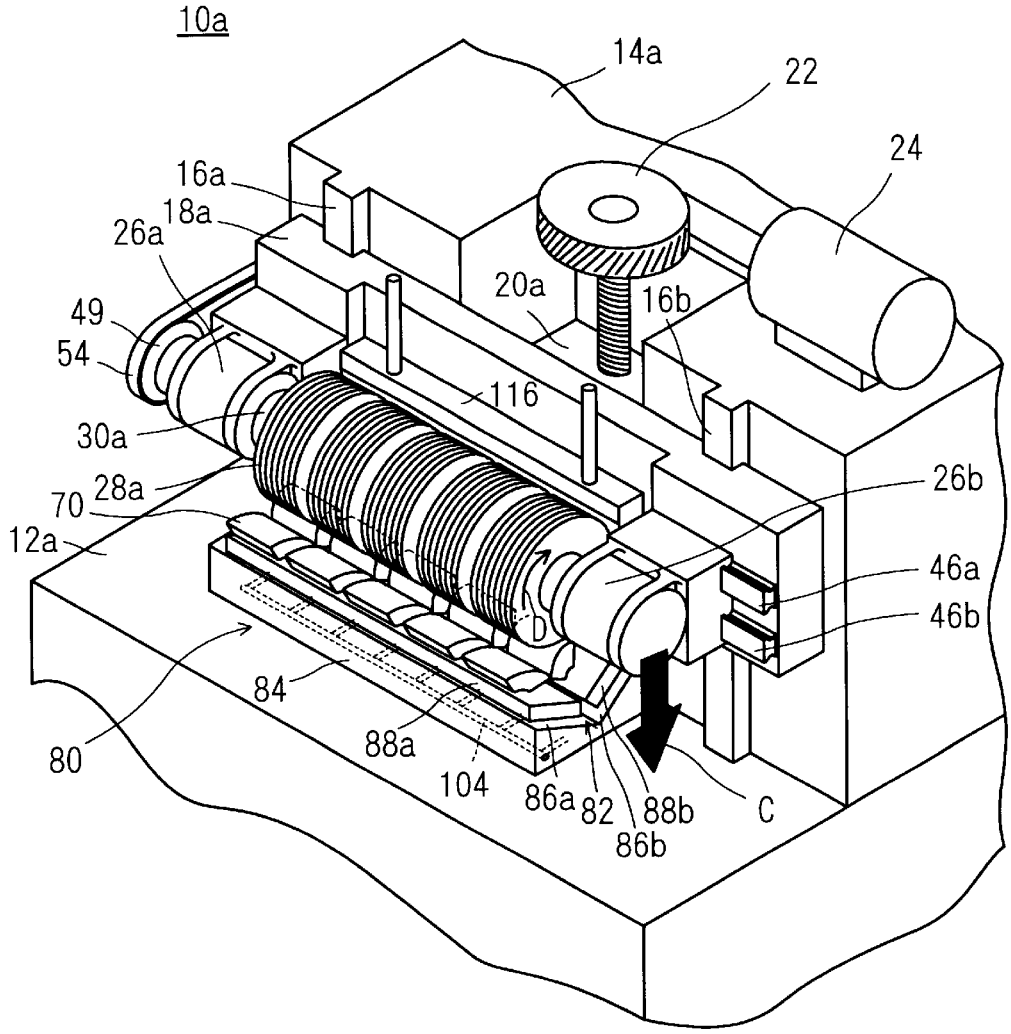
FIG. 7 is a perspective view showing a primary portion of another embodiment of the present invention.

Next, reference is made to FIG. 7 for describing a work cutting apparatus 10*a* as another embodiment.

The work cutting apparatus 10*a* is a wider variation of the work cutting apparatus 10 shown in FIG. 1. Specifically, a bed 12*a*, a column 14*a*, a slider 18*a* and the slider supporting portion 20*a*, and so on are formed wider. Other components of the work cutting apparatus 10*a* essentially identical with those of the work cutting apparatus 10 are indicated by the same or similar alpha-numeral codes, and the descriptions will not be repeated for those components.

According to the work cutting apparatus 10*a*, supporting portions 26*a*, 26*b* rotatably supports a rotating shaft 30*a* mounted with a plurality of cutting blade blocks 28*a*.

Figure 8:
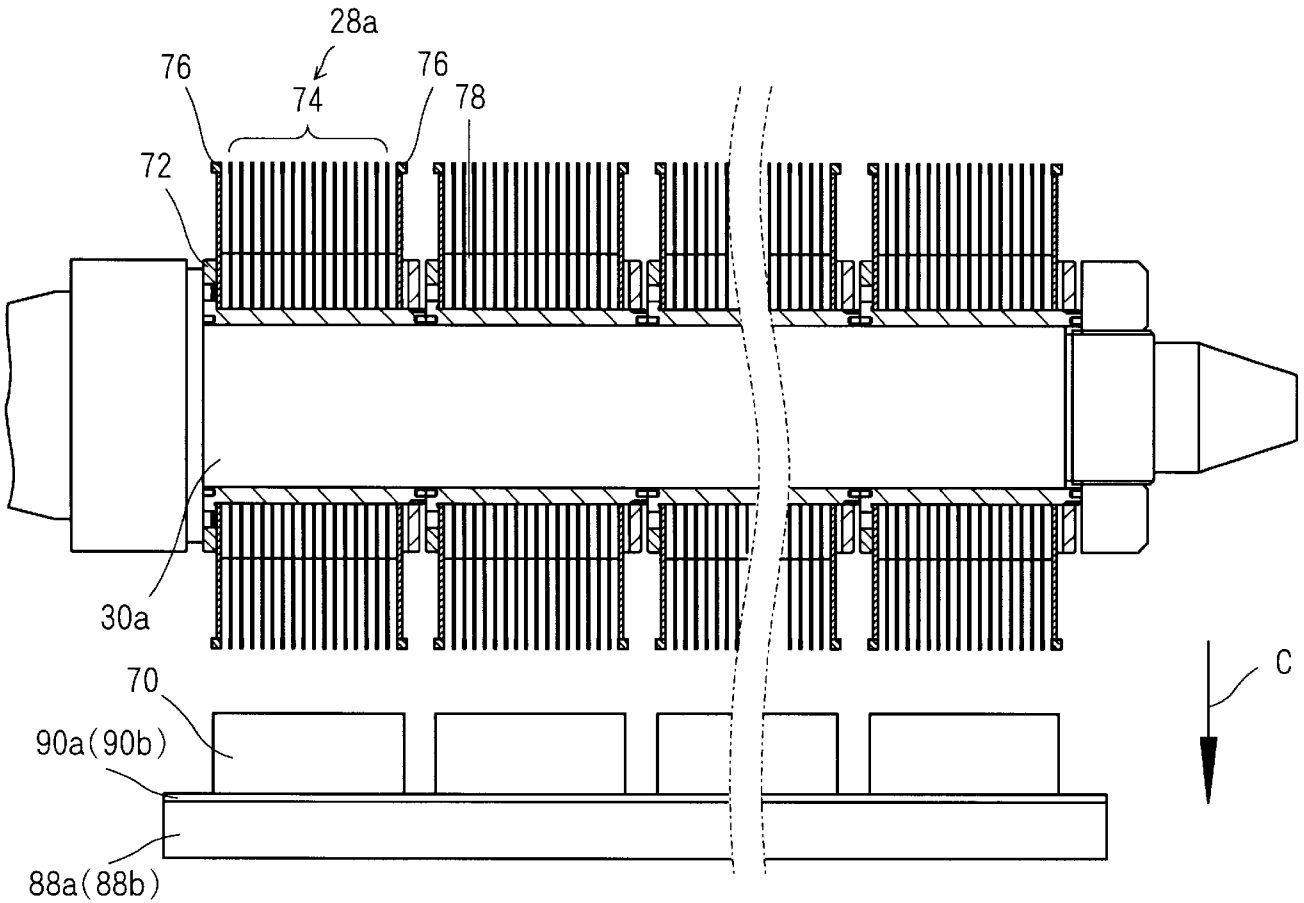
FIG. 8 is a sectional view showing a state in which a rotating shaft is mounted with cutting blade blocks.
Figure 9:
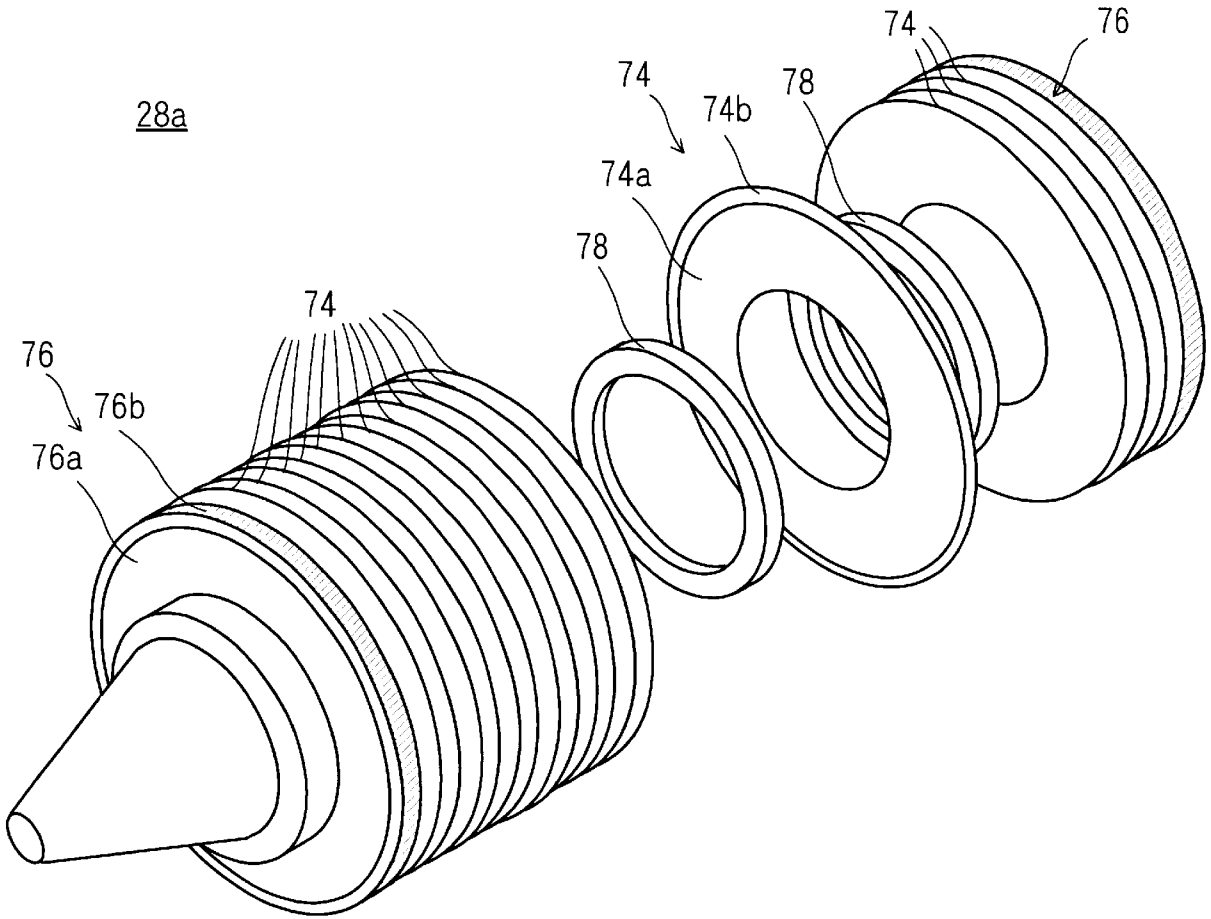
FIG. 9 is an exploded perspective view showing the cutting blade block.

As shown in FIG. 8, an outer circumferential surface of the rotating shaft 30*a* is mounted with a plurality of segment flanges 72 (five segment flanges 72 according to the present embodiment). Each of the cutting blade blocks 28*a* is mounted within one of the segment flanges 72. As shown in FIGS. 8 and 9, each of the cutting blade blocks 28*a* includes a plurality of cutting blades 74, with a thicker cutting blade 76 placed at each end. Each pair of the cutting blades is interposed by a spacer 78. Specifically, the cutting blades 74 and the spacers 78 are alternated, with the cutting blade 76 placed at each end. Dimensions of the cutting blade blocks 28*a* and the segment flanges 72 are determined in accordance with dimensions of the works 70 to be cut.

The cutting blades 74 and 76 respectively include disc-like substrates 74*a* and 76*a*. The substrates 74*a* and 76*a* respectively have outer circumferential edges mounted with cutting edges 74*b* and 76*b*. The substrates 74*a* and 76*a* should preferably be made of super hard metal such as tungsten carbide having a Young's modulus of 441,315 $N/mm^2$~686,490 $N/mm^2$. The material meeting the above condition reduces blade deflection, making possible to narrow a margin allowed for the cutting blades 74 and 76, allowing to cut the work 70 more thinly. If the Young's modulus is smaller than 441,315 $N/mm^2$, even the super hard metal is bent or made wavy by resistance during the cutting operation. As a result, the substrate 74*a* cannot be made thin enough, losing advantages of using the super hard metal. On the other hand, if the Young's modulus is greater than 686,490 $N/mm^2$, although there is no problem in terms of bending or waving, the metal is harder and more brittle, being susceptible to failure during use, posing safety problems. For these reasons, the value of Young's modulus is limited to the range between 441,315 $N/mm^2$~686,490 $N/mm^2$. The cutting edges 74*b*, 76*b* include diamond abrasive grains for example.

According to the present embodiment, for example, the substrate 74*a* has a thickness of 0.6 mm, the spacer 78 has a thickness of 2.5 mm, and the thicker substrate 76*a* has a thickness of 3 mm. By increasing the thickness of the cutting blade 76 at each end, each end margin of the work 70 can be ground into dust.

Further, preferably, the cutting blades 74 and 76 should have a radius greater than a radius of the spacers 78 by a length equal to (a thickness of the work 70 +a thickness of a comb-like portion 98).

Returning to FIG. 7, a bed 12*a* has an upper surface provided with a work disposing portion 80 located right below the cutting blade blocks 28*a*. The work disposing portion 80 includes a table 84 made of carbon for example.

Figure 10:
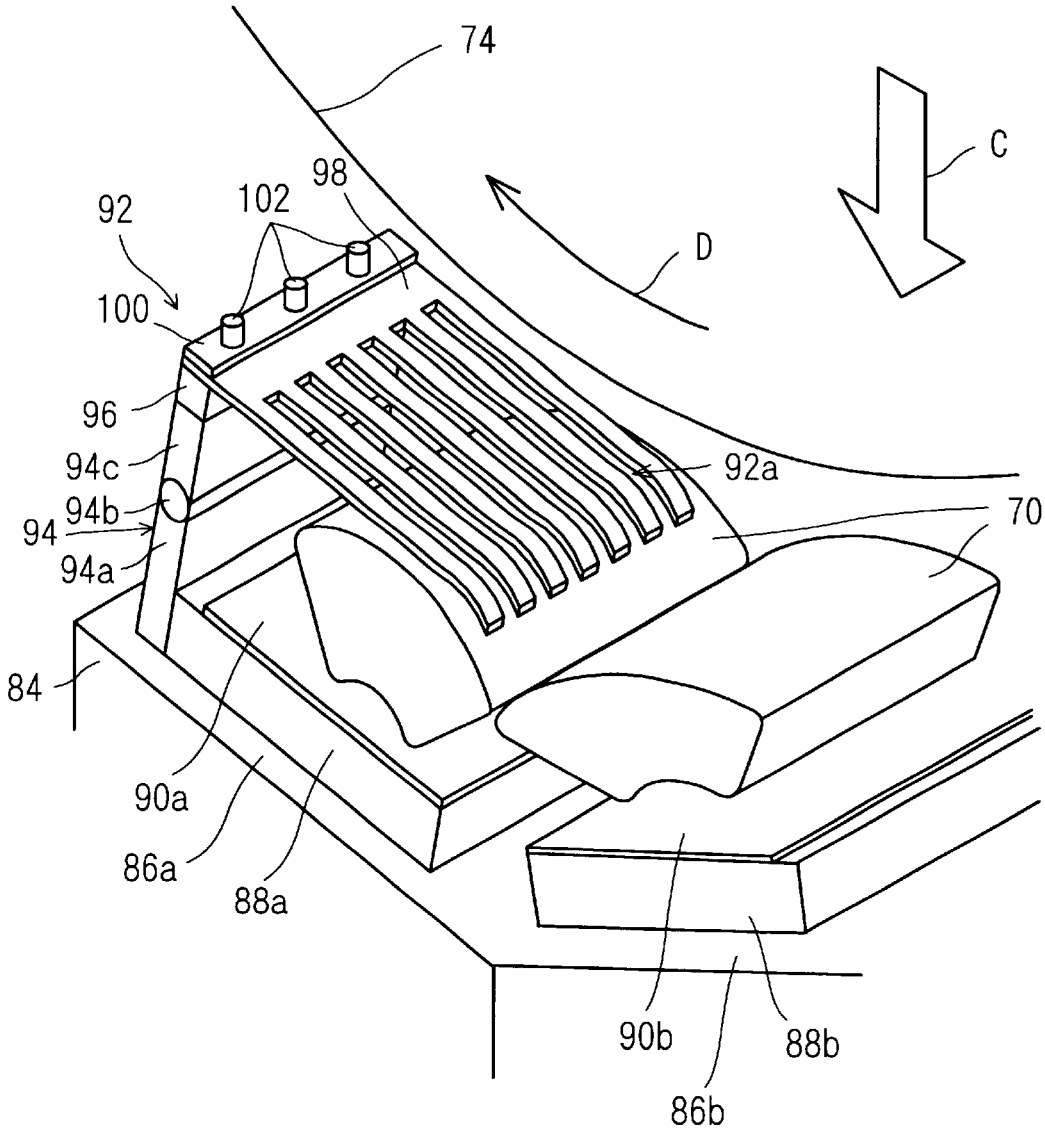
FIG. 10 is a perspective view showing a fixing member.

The table 84 includes a recess 82 having a generally V-shaped section, with slopes 86*a*, 86*b* respectively mounted with disposing boards 88*a*, 88*b*. As shown in FIG. 10, the disposing boards 88*a*, 88*b* have respective upper surfaces formed with coating members 90*a*, 90*b* made of a resin for example, having a high coefficient of friction. With the above construction, the coating members 90*a*, 90*b* are disposed in a shape of V. When a cutting operation is performed, each of the works 70 is placed on the coating members 90*a*, 90*b* at a place corresponding to one of the cutting blade blocks 28*a*. According to the present embodiment, each of the coating members 90*a*, 90*b* is placed thereon with five pieces of the works 70, i.e. a total of ten works 70 are placed.

Further, as shown in FIG. 10, a clamp-like fixing member 92 for fixing the work 70 is provided on each of the slopes 86*a*, 86*b* on the table 84, at the place corresponding to one of the cutting blade blocks 28*a*. According to the present embodiment, a total of ten fixing members 92 are provided corresponding to the total of ten works 70. Each of the fixing members 92 includes a base portion 94 standing on the corresponding slope 86*a* or 86*b*. The base portion 94 includes a lower portion 94*a* and an upper portion 94*c* pivotally connected to the lower portion 94*a* via a shaft 94*b*. The base portion 94 has an upper end portion provided with an adjusting portion 96, whereupon an end portion of the comb-like portion 98 is positioned in a shape of L. The comb-like portion 98 is held by a plate member 100 and fixed by screws 102 threaded from above. Preferably, the comb-like portion 98 should be made of an elastic member such as a spring.

By using the adjusting portion 96 having a different height or different slanting angle of its top surface, a mounting angle of the comb-like portion 98 can be varied, and pressing force to the work 70 can be varied. Further, by adjusting curvature of the comb-like portion 98 of the fixing member 92, the pressing force to the work 70, and thus the friction between the work 70 and respective coating members 90*a*, 90*b* can be adjusted. The comb-like portion 98 is set so as to allow each of the cutting edges 74*b* of the cutting blades 74 to pass through corresponding gap 92*a* at the time of cutting operation.

When the work 70 is fixed by the fixing member 92, a surface of the work 70 to be faced with the cutting blades 74, 76, i.e. the upper surface of the work 70, is pressed by the comb-like portion 98 to the table 84. By such a clamping, the work 70 can be held fixed during the cutting operation. The pressure from the fixing member 92 can be removed by outwardly tilting the upper portion 94*c* of the base portion 94. If the fixing member 92 is used, adjustment of the pressing force exerted to the work is not difficult. Thus, the work will not be chipped or otherwise damaged when being fixed even if the work is a member which is thin or fragile.

Figure 11A:
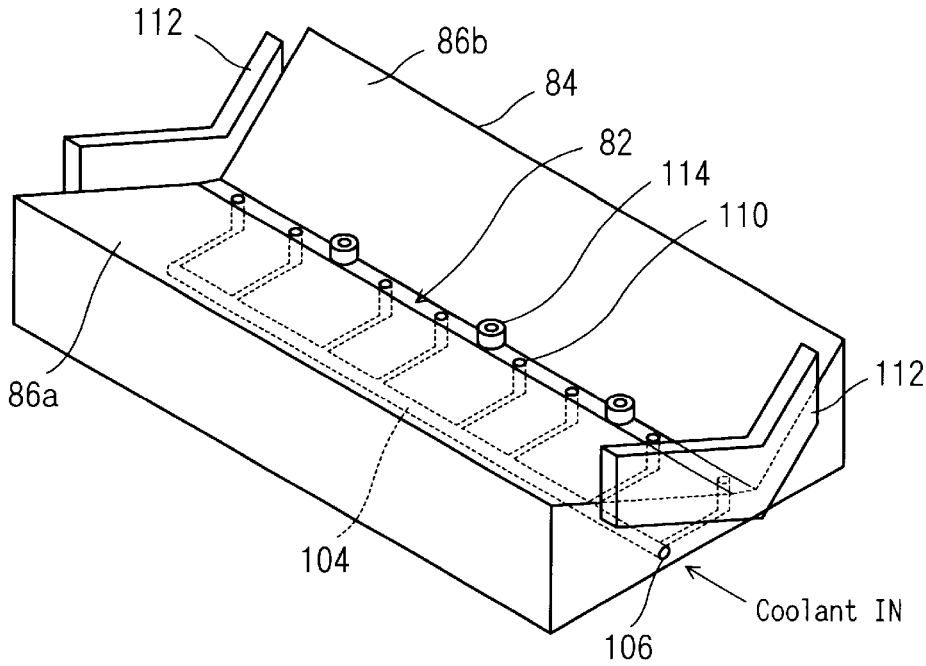
FIGS. 11A and 11B are a perspective view and a conceptual diagram showing a coolant supplying portion and an enclosing member provided in a table respectively.
Figure 11B:
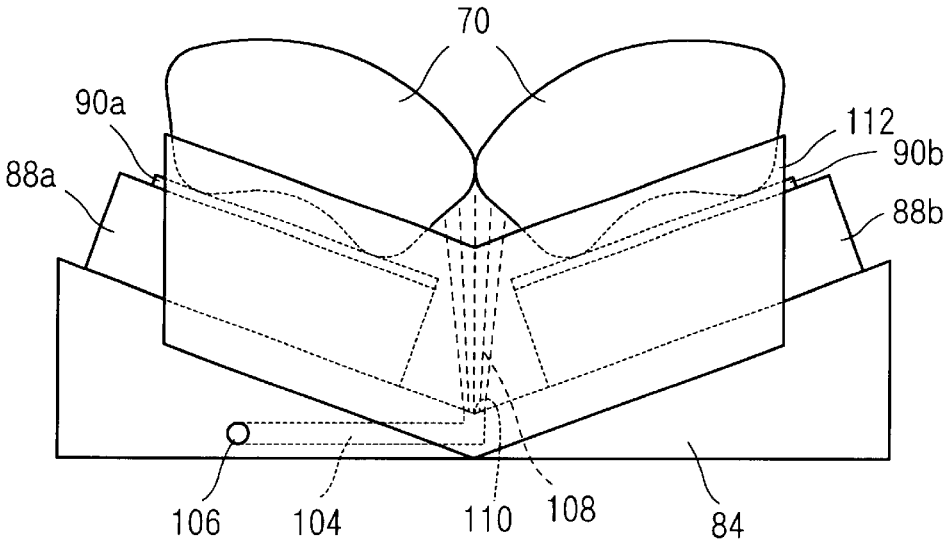

Further, as shown in FIGS. 11A and 11B, a coolant supplying path 104 serving as a coolant supplying portion is formed within the table 84. The table 84 has a side surface formed with a hole 106 from which a coolant 108 is supplied to the coolant supplying path 104. The coolant 108 is discharged upwardly from a plurality of holes serving as supplying ports 110 provided in a bottom portion of the recess 82 of the table 84. The coolant 108 is discharged under a pressure of 196,140 Pa~1,471,050 Pa, or more preferably, at 294,210 Pa~686,490 Pa.

The table 84 has side surfaces each attached with a plate of enclosing member 112 so as to enclose the recess 82, making possible to hold the coolant 108 in the recess 82. If the enclosing members 112 are provided, the discharge pressure of the coolant 108 may not be greater than 294,210 Pa. It should be noted here that the bottom portion of the recess 82 is formed with positioning pins 114 for the disposing boards 88*a*, 88*b*.

Figure 12:
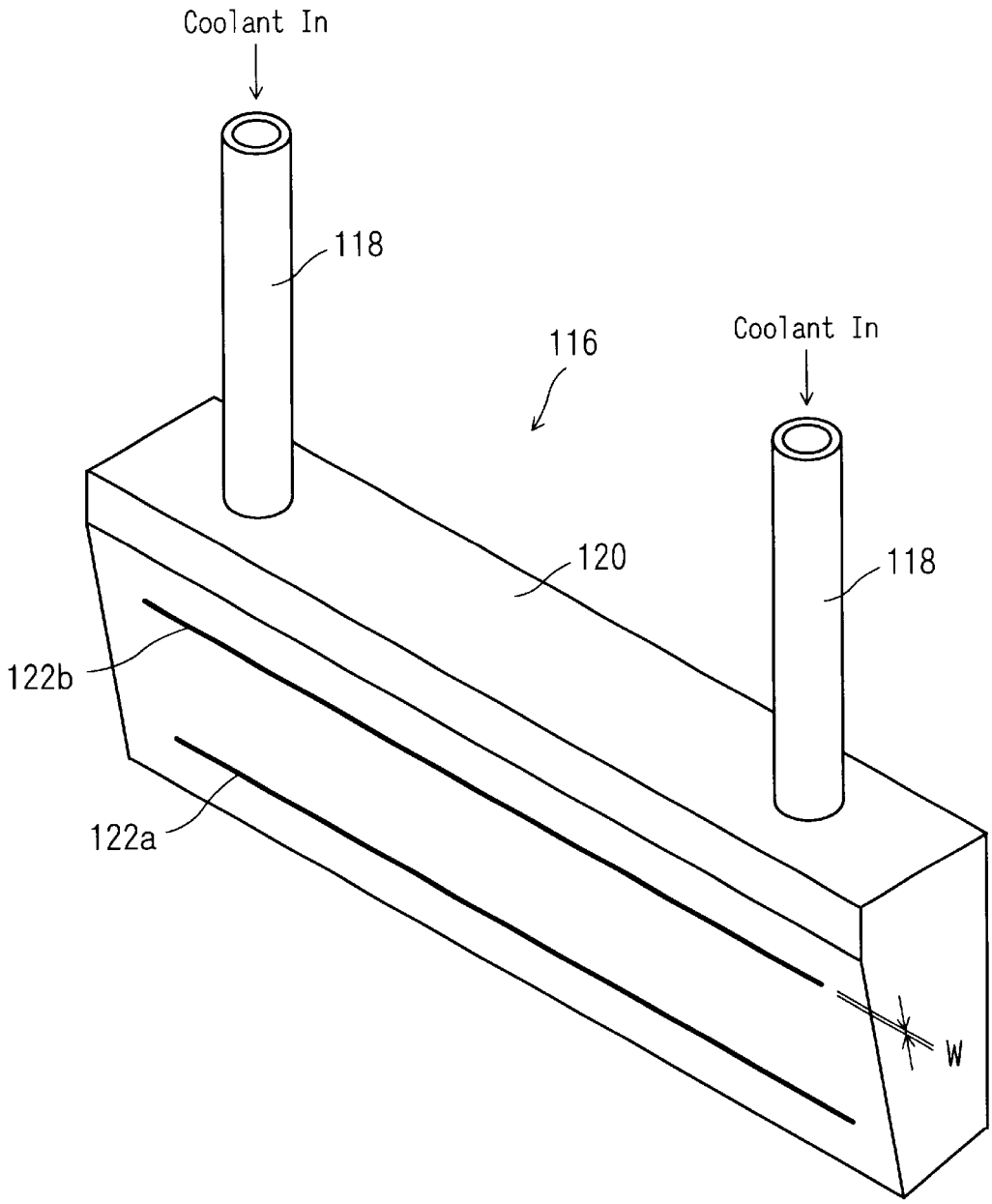
FIG. 12 is a perspective view showing a coolant supplying portion mounted to the slider.

Further, as shown in FIGS. 7 and 12, the slider 18*a* has a side surface provided with a coolant supplying portion 116 facing the cutting blade blocks 28*a*. As shown also in FIGS. 15A and 15B, the coolant supplying portion 116 includes a coolant supplying path 118 and a tank 120. The tank 120 has a front surface formed with slits serving as supplying ports 122*a*, 122*b* spaced vertically from each other. Specifically, the port 122*a* is formed closer to the work 70 whereas the port 122*b* is formed on an upstream side of the port 122*a* relative to the direction of rotation of the cutting blades 74, 76. Each of the supplying ports 122*a*, 122*b* has a width W of the slit of 1 mm~2 mm for example.

Figure 15A:
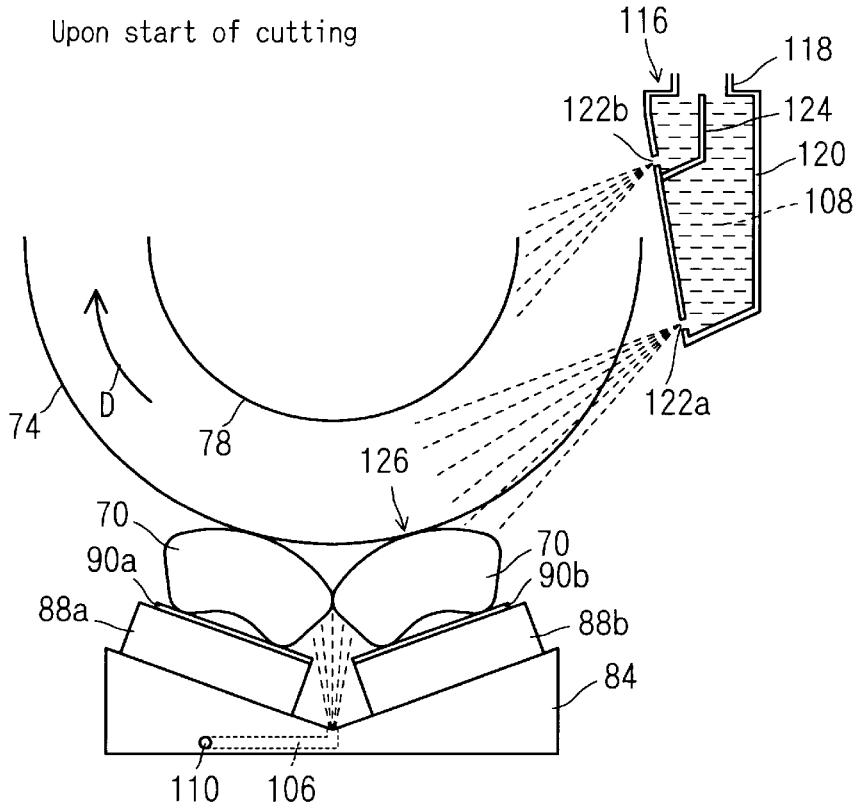
FIGS. 15A and 15B are conceptual diagrams showing states of coolant supply according to the embodiment shown in FIG. 7.
Figure 15B:
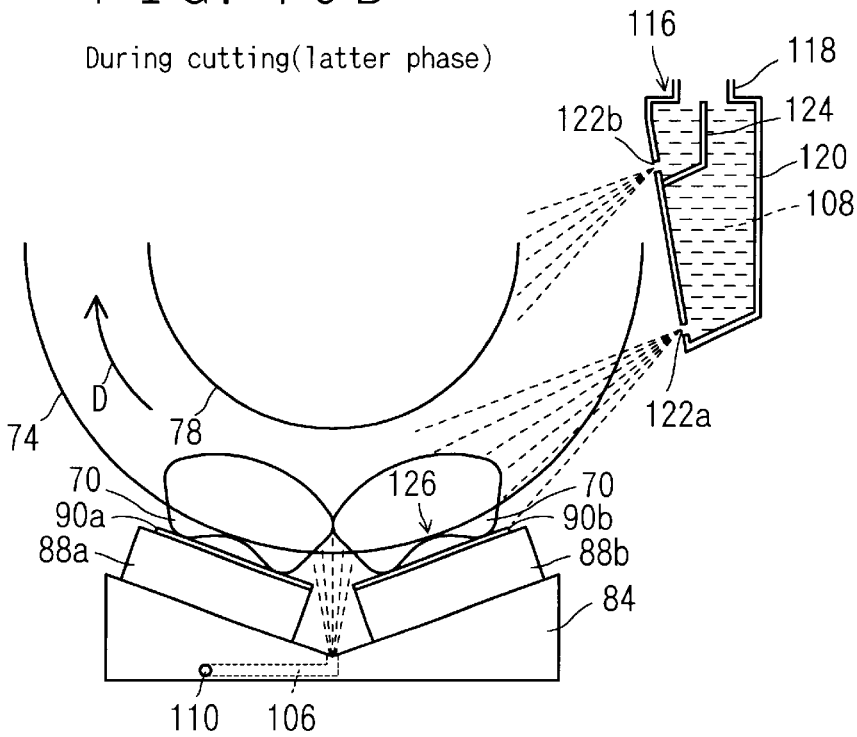

As will be understood from FIGS. 15A and 15B, a generally L-shaped weir board 124 is provided within the tank 120 for maintaining a constant pressure of the discharged coolant 108. The coolant 108 is fed to the tank 120 via the coolant supplying path 118, and then discharged from the ports 122*a*, 122*b*.

With the above arrangement, the discharge pressure of the coolant is 196,140 Pa~1,471,050 Pa. Within this range, the cutting blades 74, 76 containing resin-bound diamond are abraded efficiently, cutting the works 70 smoothly. The discharge pressure of the coolant 108 should more preferably be 294,210 Pa~686,490 Pa. Within this range, the discharge pressure will not deform the cutting blades 74, 76, making possible to accurately cut the works 70.

The lower port 122*a* supplies the coolant 108 to a cutting portion 126 where the works 70 make contact with the cutting blades 74, 76. The upper port 122*b* supplies the coolant 108 toward the work 70 on a downstream side of the rotating direction of the cutting blades 74, 76, i.e. toward the left work 70 shown in FIGS. 15A and 15B.

Now, main actions of the work cutting apparatus 10*a* will be described with reference to FIG. 13A through FIG. 13D.

Figure 13A:
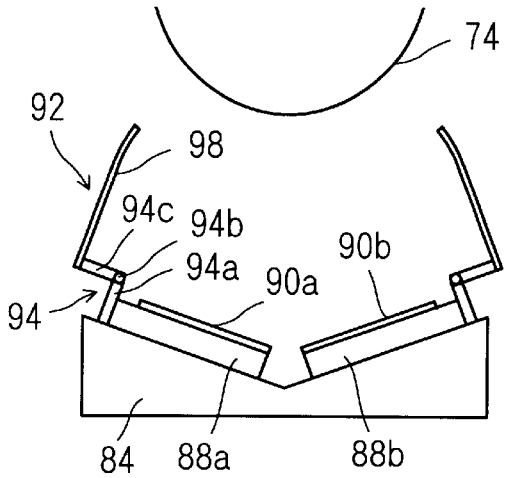
FIGS. 13A through 13D are conceptual diagrams showing actions in the embodiment in FIG. 7.
Figure 13B:
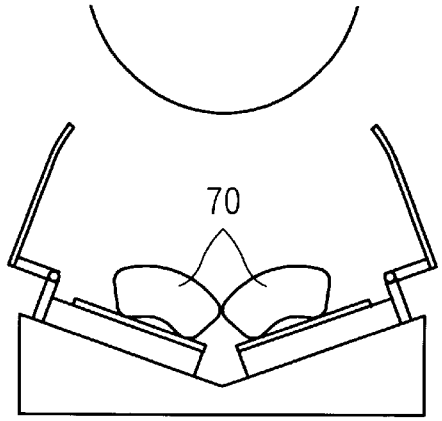
Figure 13C:
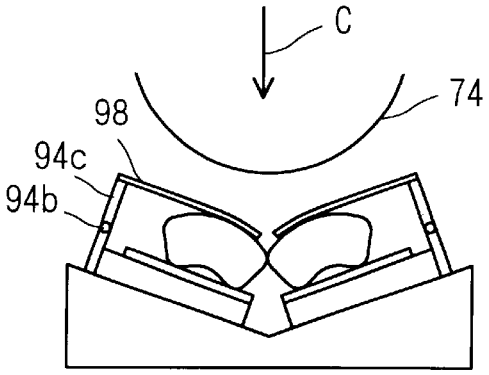
Figure 13D:
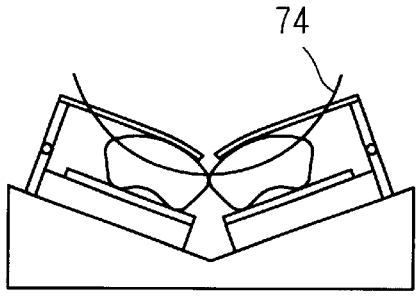

First, as shown in FIG. 13A, the upper portions 94*c* of the base portions 94 are tilted outwardly, so that the works 70 can be placed. Then, as shown in FIG. 13B, works 70 are placed on the coating members 90*a*, 90*b* respectively. Then, the upper portions 94*c* of the base portions 94 are placed back to the original positions as shown in FIG. 13C, so that the works 70 are fixed, with respective upper surfaces being pressed by the comb-like portions 98 from above. Then, a start button (not illustrated) is pressed to start a cutting operation; whereupon the cutting blades 74 and 76 begin rotating and lowering toward the works 70, soon begin cutting the works 70 as shown in FIG. 13D while keeping rotation at a constant speed. During this process, the works 70 comes under a reacting force against the cutting. However, since the works 70 are fixed by the fixing members 92, the works 70 can be held reliably until the cutting is complete, preventing the works 70 from rattling during the cutting operation. This eliminates a case in which the work 70 falls after completion of the cutting, making contact with and damaged by the rotating cutting blades 74 or 76. Upon completion of the cutting of the works 70, at which the cutting edges 74*a*, 74*b* of the cutting blades 74, 76 reach the disposing board 88*a*, 88*b*, the rotation of the cutting blades 74, 76 is automatically stopped, and then the cutting blades 74, 76 are raised to leave the works 70. It should be noted here that during the cutting operation of the works 70, the coolant 108 is discharged from the ports 122*a*, 122*b* of the coolant supplying portion 116 and ports 110 of the coolant supplying path 104.

Figure 23:
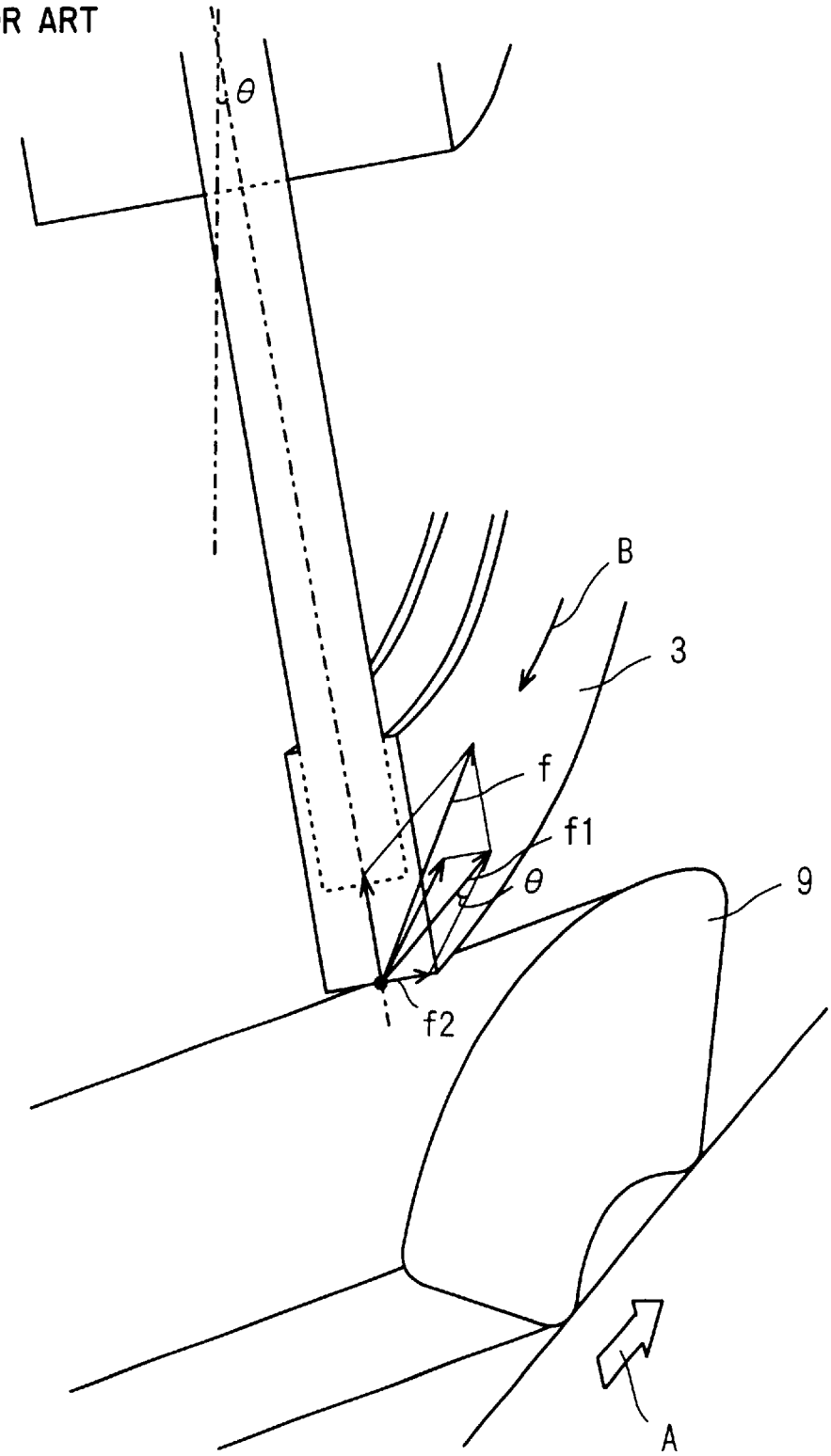
FIG. 23 PRIOR ART
FIG. 23 is a conceptual diagram showing relationship in reactive force acting on a cutting blade during a cutting operation according to the conventional art shown in FIG. 22.

According to the work cutting apparatus 10*a* as described above, a force which deforms the cutting blade 74 inevitably becomes smaller than in the convention shown in FIG. 23, similarly to the case of work cutting apparatus 10 shown in FIG. 4. As a result, it becomes possible to reduce deformation of the cutting blade 74, resulting in improvement in cutting accuracy. Further, deferring from the convention, the works 70 are disposed in a shape of V, and the cutting is made from above instead of from a side. Thus, the works 70 will not be displaced out of the place by the pressing force applied in the cutting operation, resulting in improved dimensional accuracy as well as better quality in cut surface of the work 70. Further, by disposing a plurality of works 70 in the recess 82 across planes each including one of the cutting blades 74, a large number of works 70 can be cut in a single cutting operation.

The cutting blade 74 includes a substrate 74*a* made of a super hard metal such as tungsten carbide. As has been described above, this makes possible to reduce deformation and deflection of the cutting blade 74. Thus, a thickness of the substrate 74*a* can be further reduced, and the number of pieces obtained per work 70 can be increased Further, each of the works 70 can be set in alignment with corresponding one of the cutting blade blocks 28*a*, whereas the cutting blades 74, 76 are mounted at a high accuracy. Thus, it becomes possible to reduce inclusion of dimensionally inferior products particularly if there is dimensional inconsistency in the works 70.

Further, the thickness of the cutting blade 76 at each end of the cutting blade block 28*a* is made greater than the thickness of the cutting blades 74. This makes possible that each end margin of the work 70 potentially becoming a dimensionally inferior product can be ground into dust, preventing inclusion of the inferior products. Thus, yield can be improved, and productivity can be improved.

Figure 14:
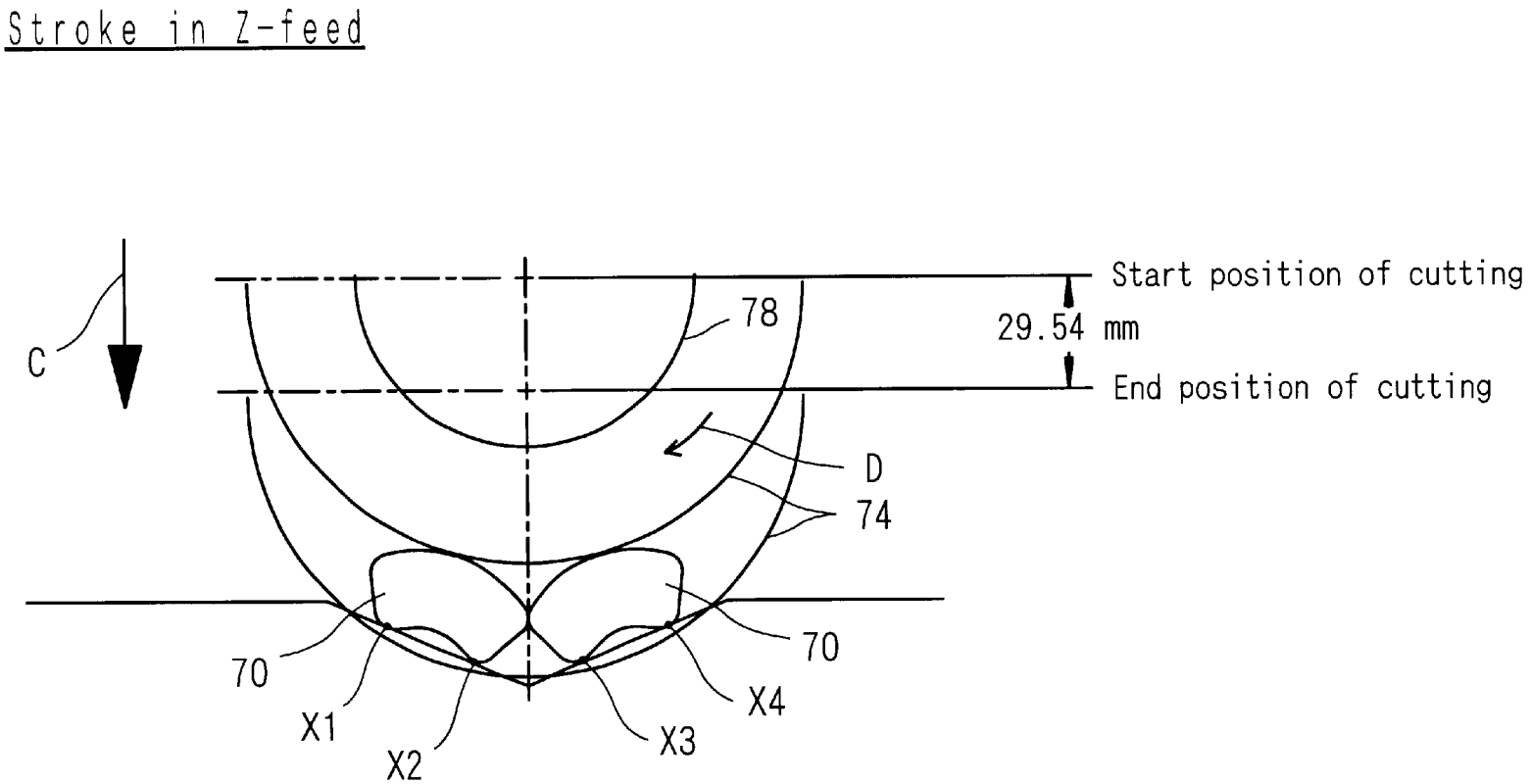
FIG. 14 is a conceptual diagram showing a cutting stroke according to the embodiment in FIG. 7.

Further, as shown in FIG. 14, a stroke of the cutting blade 74 from a start position of cutting to an end position of the cutting by the work cutting apparatus 10*a* is 29.54 mm, being shortened as compared to that of the convention shown in FIG. 24. Specifically, by forming the V-shaped recess 82 on the upper surface of the table 84 as shown in FIG. 7, and by cutting from above, the cutting stroke can be shortened and work cutting time can be reduced remarkably. Moreover, by disposing the works 70 at a same distance from the rotating shaft 30*a*, the cutting stroke can be further shortened. Further, the cutting stroke of the works 70 can be further shortened for even shorter cutting time and more improved productivity by the following arrangement. Specifically, the slopes 86*a*, 86*b* of the table 84 (i.e. the coating members 90*a* and 90*b*) are set to an angle (of the V) as shown in FIG. 14, so that four points X1, X2, X3 and X4 of respective bottom portions of the two works 70 will be passed simultaneously by the cutting edge 74*b* of the cutting blade 74.

Further, if the radius of the cutting blades 74, 76 is set to a radius of the spacer added by (a thickness of the work 70+a thickness of the comb-like portion 98) for example, the radius of the cutting blades 74, 76 can be shortened. According to this arrangement, change in load acting on the cutting blades 74, 76 becomes smaller when cutting the work. Thus, the number of revolutions of the cutting blades 74, 76 can be stabilized, the deflection of the cutting blades 74, 76 can be reduced, leading to improved quality of the cut surface of work 70.

Further, as shown in FIG. 8, a predetermined number of cutting blades 74 and 76 are assembled into a block to form the cutting blade block 28*a*, and a plurality of the cutting blade blocks 28*a* are mounted to the rotating shaft 30*a*. Therefore, thickness-wise mounting error in each of the cutting blades 74, 76, and the spacers 78 will not adversely affect adjacent cutting blade blocks 28*a*; i.e. the error will not accumulate. This maintains the cutting accuracy, reducing inclusion of dimensionally inferior products. As a result, a greater number of products of a good quality can be obtained even if the number of cutting blades 74 mounted to the rotating shaft 30*a* is increased, making possible to improve productivity. An experiment showed that a maximum number of the cutting blades which could be mounted was fifty according to the conventional work cutting apparatus 1. On the other hand, according to the work cutting apparatus 10*a*, the number was increased to a hundred.

Since the work 70 is fixed by the fixing member 92 from above for the cutting, the cutting can be achieved without bonding the work 70 by adhesive. Thus, operations necessary for bonding and un-bonding become unnecessary, leading to improved productivity. An experiment showed that when a work of a size 20 mm×40 mm×60 mm was cut by the conventional work cutting apparatus 1, fifty-five minutes had to be used for bonding and un-bonding operations. On the other hand, according to the work cutting apparatus 10*a*, none of these operations were necessary, and therefore these operations could be eliminated. As for the cutting time, the work cutting apparatus 1 needed 18.5 minutes, whereas the work cutting apparatus 10*a* could decrease the time to 10 minutes. Therefore, the productivity can be improved.

It should be noted that by forming the recess 82 to have a V-shaped section, cost of machining the table 84 can be reduced, and applicability to a variety of kinds of works is achieved. Especially, a plate-like work can be positioned stably without rattling.

Further, the angle of the which is the section of the recess 82 can be varied according to the shape and other conditions of the work. Further, if a work having a concave bottom surface such as the work 70 is to be placed, the coating members 90*a*, 90*b* may be formed with corresponding curvatures. Still further, the recess 82 may have an arcuate section. Especially in such a case, it is more preferable in further reducing the cutting time if the section should have the same curvature as of the cutting blade 74.

Further, according to the work cutting apparatus 10*a*, the supplying ports 122*a*, 122*b* provided in the coolant supplying portion 116 supply the coolant 108 from different locations. Moreover, by supplying the coolant 108 to the works 70 from the plurality of locations, the coolant 108 can be supplied reliably even if the cutting blades 74, 76 have an increased area of contact with the works 70 as shown in FIG. 15B. Therefore, the cutting blades 74, 76 can be abraded efficiently, making possible to cut the works 70 accurately and productively.

Further, since the coolant 108 is supplied to the cutting blades 74, 76 and the works 70 from the same side thereof and from the plurality of locations, sludge can be discharged smoothly.

Further, discharge of the coolant 108 from the supply port 122*b* makes possible to supply the coolant 108 to the work 70 located on the downstream side of the rotation of the cutting blades 74, 76. In this situation, the coolant 108 hitting the spacer 78 is spun off the spacer 78 and directed toward the downstream side work 70. Further, the coolant 108 from the supplying port 122*b* interrupts an accompanying stream of air which follows the rotating cutting blades 74, 76. Therefore, the coolant 108 from the supply port 122*a* becomes less affected by the accompanying stream, making possible to supply the coolant 108 more reliably from the supplying port 122*a* to the works 70.

Further, if the cutting blades 74, 76 include resin-bound diamond, insufficient amount of supply of the coolant 108 will cause abnormal friction in the cutting blades 74, 76, deteriorating the cutting accuracy. Thus, the present invention is especially effective.

Further, if the work 70 is a sintered compact such as a magnetic member, poor cutting accuracy easily cause cracking or chipping. Thus, the present invention is especially effective.

Further, by forming the supplying port 110 of the coolant 108 in the recess 82, it becomes possible to supply the coolant 108 to portions where the coolant supply portion 116 can not efficiently supply the coolant 108 such as a side surface of the work 70. Thus, cutting accuracy of the work 70 is improved further. This arrangement is especially effective if the work 70 has a large thickness.

Further, by enclosing the recess 82 by the enclosing members 112, it becomes possible to hold the coolant 108 in the recess 82. Thus, the work 70 can be cut while the work 70 is being bathed in the coolant 108. In addition, even if the discharge pressure from the supply port 110 is lower than the discharge pressure from the supply ports 122*a*, 122*b*, the coolant 108 can be supplied to the cutting blades 74, 76. Thus, the cutting accuracy of the work 70 can be further improved. Especially, it becomes possible to supply the coolant 108 sufficiently to the work 70 on the downstream side of rotation of the cutting blades 74, 76, which also prevents sludge buildup, facilitating accurate cutting of the work 70.

Now, description will cover an experiment conducted to the work cutting apparatus 10.

The experiment was made under the conditions shown in Table 1:

TABLE 1

| | | |
|---|---|---|
| Work | Dimensions: | Height of cutting = 25 mm<br>Thickness of cutting = 2 mm |
| | Material: | Rare-earth permanent magnet |
| Cutting apparatus | Z axis-feed type cutting apparatus | |
| Cutting blade | Resin-bound diamond | Artificial diamond |
| | Abrasive grain: | |
| | Grain diameter: | 200 μm~250 μm |
| | Binder: | Resin (phenol, nonporous) |
| | Rate of diamond by volume: | 30% |
| | Substrate: | Super hard metal |
| | Dimensions: | |
| | Outer diameter; | 150 mm |
| | Cutting edge thickness; | 0.6 mm |
| | Substrate thickness; | 0.5 mm |
| | Inner diameter; | 60 mm |
| | (Spacer) | |
| | Outer diameter; | 90 mm |
| | Thickness; | 2.5 mm |
| | Inner diameter; | 60 mm |
| | 15 blades assembled in a block | |
| Cutting speed | 30 mm/min | |
| Rotating speed | 2000 m/min | |
| Coolant | Discharge volume: | 20 liters/min~30 liters/min |
| | Discharge pressure: | 196, 140 Pa~294, 210 Pa |

TABLE 1-continued

| Type of coolant: | Chemical solution type 2% dilution |
|---|---|
| Number of cutting cycles | 100 passes |

Figure 16A:
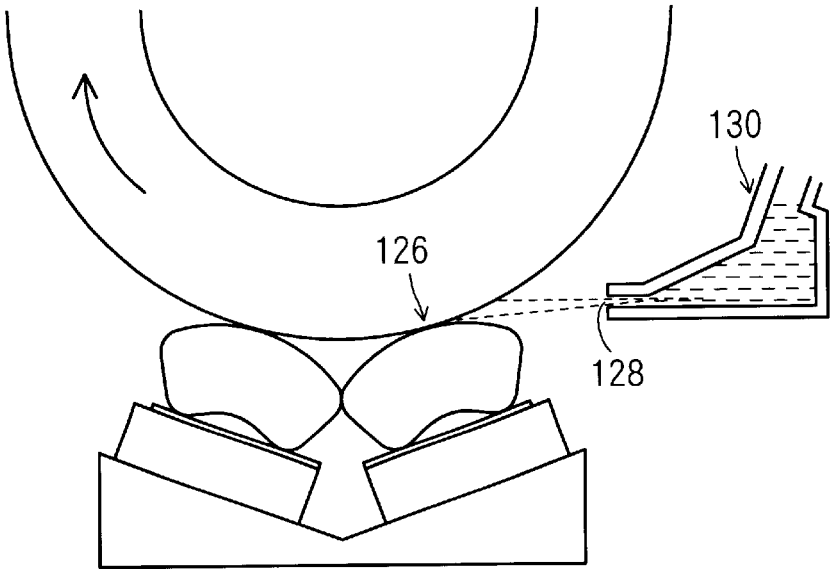
FIGS. 16A and 16B are conceptual diagrams showing states of coolant supply when a coolant supplying portion having one supply port is used.
Figure 16B:
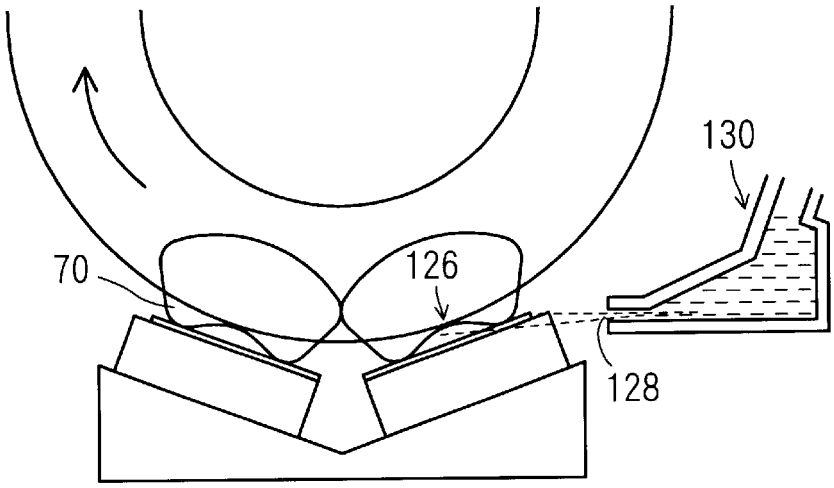

Cuttings were made in the setting shown in FIGS. 15A, 15B, and in the setting shown in FIGS. 16A, 16B. For each setting, "dimensional inconsistency", "parallelism" and "abrasion rate" were measured.

FIGS. 15A, 15B respectively show state of coolant supply upon start of cutting and during (in a latter phase of) the cutting by the work cutting apparatus 10*a* provided with the coolant supplying portion 116 and the coolant supplying path 106.

FIGS. 16A, 16B respectively show state of coolant supply upon start of cutting and during (in a latter phase of) the cutting when only the coolant supplying portion 130 having one supplying port 128 was used as the coolant supplying portion. Other arrangements in the case shown in FIGS. 16A, 16B are the same as in the work cutting apparatus 10*a*.

Figure 17A:
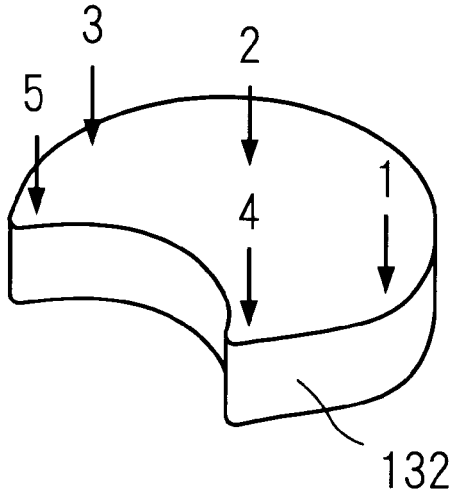
FIGS. 17A and 17B are conceptual diagrams for describing dimensional inconsistency and parallelism respectively.
Figure 17B:
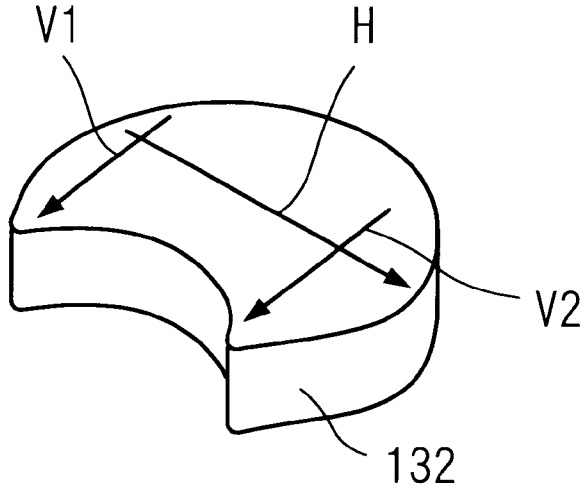

The "dimensional inconsistency" was determined by the following method. Specifically, the thickness of a piece 132 obtained by cutting the work 70 was measured at five points as shown in FIG. 17A. Then, a difference between a maximum value and the minimum value of the thickness was obtained as the "dimensional inconsistency". The "parallelism" was determined by the following method. Specifically, as shown in FIG. 17B, the thickness of the piece 132 was measured along two parallel arrows V1, V2, and along another arrow H drawn perpendicular to the arrows V1, V2. Then, a difference between a maximum value and a minimum value was obtained for each of the directions V1, V2, and H. Then, the three values were averaged to give the "parallelism". In the present experiment, the measurements for the "dimensional inconsistency" and "parallelism" were made every 10 passes, and to all of the pieces 132 obtained from the pass. When the 100th pass was completed, obtained measurement values of the "dimensional inconsistency" and "parallelism" were respectively averaged to obtain values shown in FIG. 18A. The "abrasion rate" was determined by averaging an amount of radial abrasion in each of the cutting blades 74, 76 measured upon completion of the 100 passes.

The experiment revealed that the work cutting apparatus 10*a* could supply the coolant sufficiently. On the other hand, when only the coolant supply portion 130 was used as the coolant supplying portion, the coolant 108 could be supplied to the cutting portion 126 upon start of the cutting operation shown in FIG. 16A. However, during (in the latter phase of) the cutting operation shown in FIG. 16B, the coolant 108 could not be supplied to the cutting portion 126, and the supply was insufficient to the downstream works 70.

Results of the experiment shown in FIG. 18A through FIG. 18C reveal that the work cutting apparatus 10*a* can cut at a smaller dimensional inconsistency, at a higher cutting accuracy.

Figures 19A, 19B:
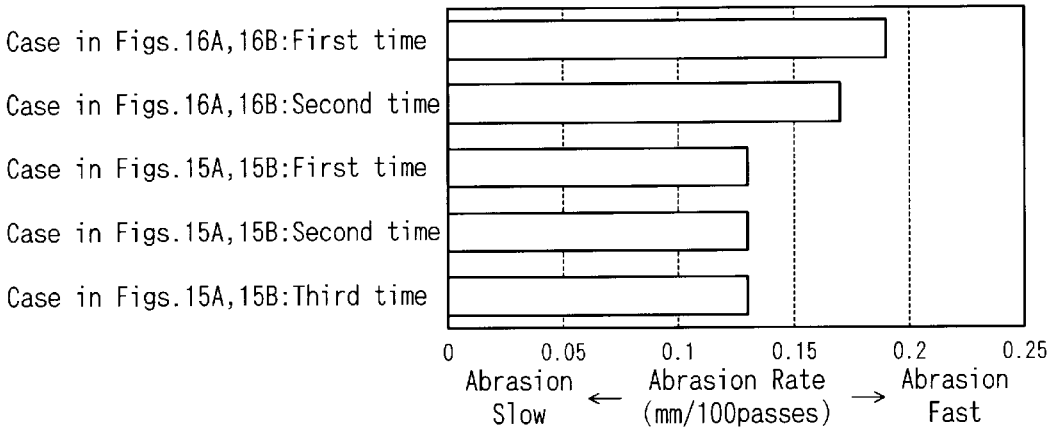

Results of the experiment shown in FIGS. 19A and 19B reveal that the work cutting apparatus 10*a* can cut at a lower abrasion rate, make longer the life of the cutting blades 74, 76, and cut the work 70 more efficiently.

As a reference, comparison was also made in the work cutting apparatus 10*a*, between two cases: In one case the coolant supplying portion only included the coolant supplying portion 116; in the other case, the coolant supplying portion included the coolant supplying portion 116 and the coolant supplying path 106. Results show that when the number of cutting operations increases, the increase in the abrasion rate becomes more significant in the case where only the coolant supplying portion 116 is used.

Figure 20:
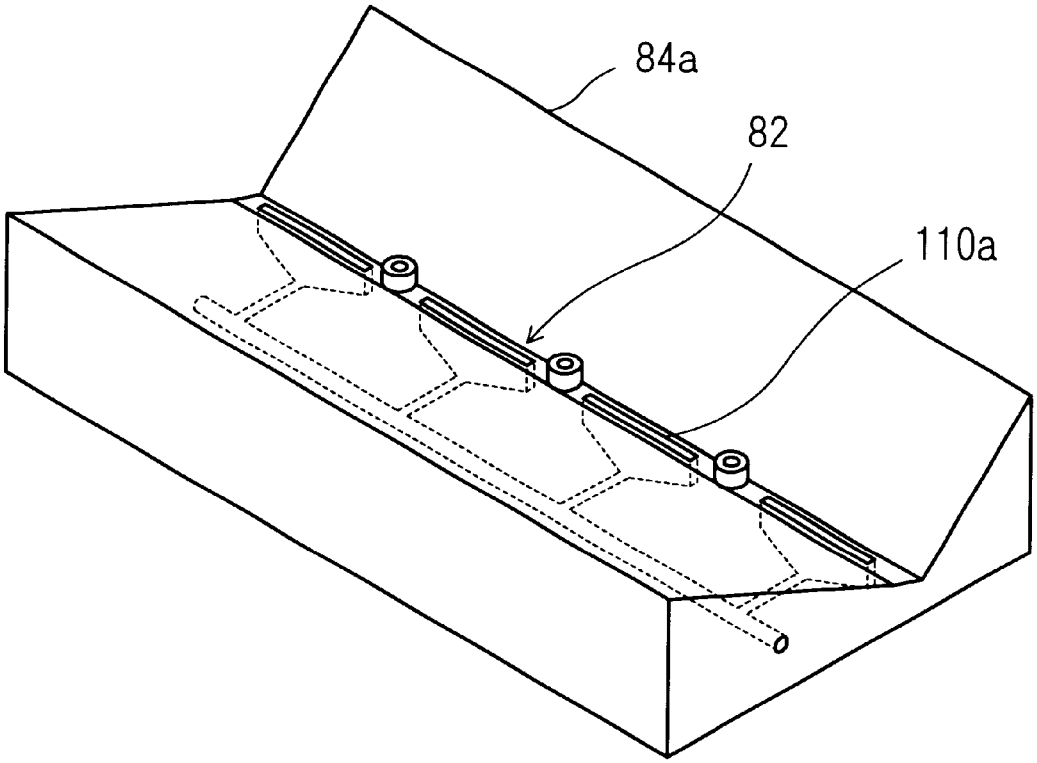
FIG. 20 is a perspective view showing another coolant supplying portion provided in the table.

It should be noted here that the work cutting apparatus 10*a* may be provided with a table 84*a* as shown in FIG. 20. The table 84*a* is provided with a recess 82 having a bottom portion formed with slit-type supplying ports 110*a*. Other constitutions are the same as of the table 84. The slit-type supplying ports 110*a* can discharge the coolant 108 more uniformly to each of the cutting blades 74, 76.

Figure 21:
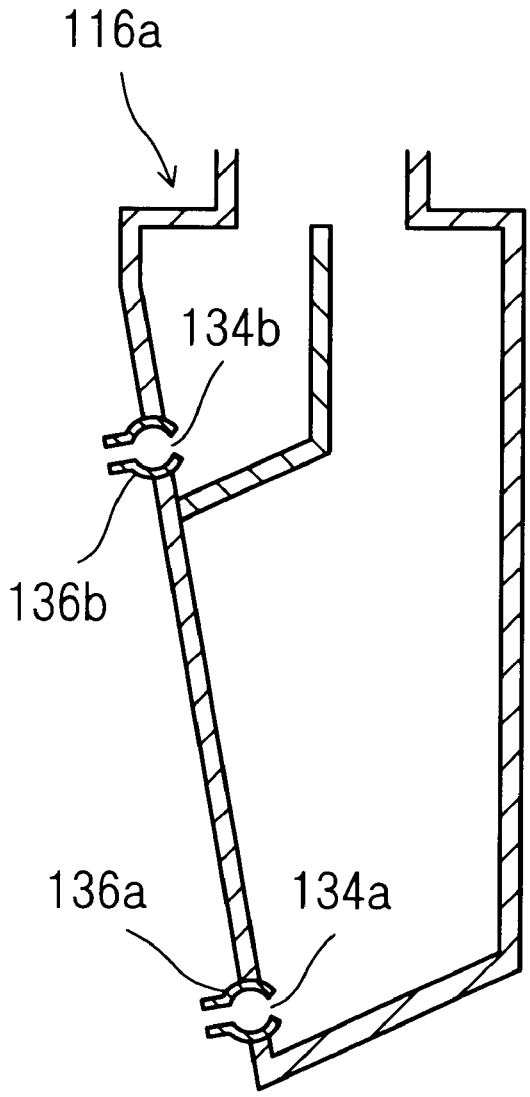
FIG. 21 is a conceptual diagram showing another coolant supplying portion mounted to the slider.
Figure 22:
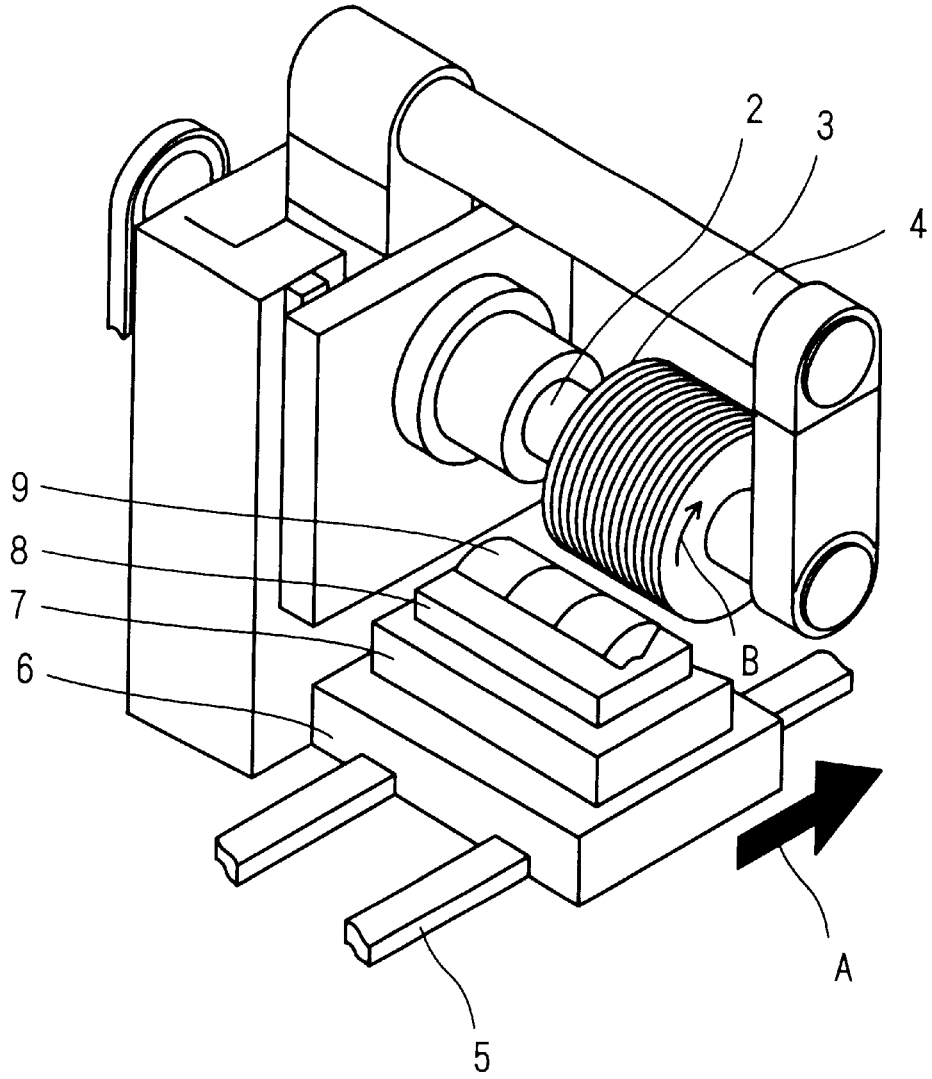
FIG. 22 PRIOR ART
FIG. 22 is a perspective view showing a convention.

Further, a coolant supplying portion 116*a* as shown in FIG. 21 may be used. The coolant supplying portion 116*a* has slit-type supplying ports 134*a*, 134*b* respectively attached with nozzles 136*a*, 136*b*. The nozzles 136*a*, 136*b* are pivotable so that the direction of discharge of the coolant 108 can be adjusted. Therefore, if the coolant supplying portion 116*a* is used, the coolant 108 can be supplied in a desired direction in accordance with the shape and size of the table 84, and the shape, size, location, etc. of the works 70.

According to the above embodiments, description was made for a case in which the cutting blades are moved toward the works 70. This is not limiting however; for example, the works 70 may be moved toward the cutting blades, further, both the works 70 and the cutting blades may be moved. Further, discretionary means may be adopted for moving the works 70 or the cutting blades, so that the direction of relative movement between the cutting blades and the works 70 at the time of the cutting is in the vertical direction or along a normal line passing a contact point between the cutting blades and the works 70.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A work cutting apparatus for cutting a work by rotation of a cutting blade, comprising:

a rotating shaft mounted with the cutting blade;

a supporting portion supporting two end portions of the rotating shaft;

a unit provided in parallel to an axial direction of the rotating shaft, mounted with the supporting portion and movable in the vertical direction perpendicular to the horizon;

a first driving portion rotating the cutting blade via the rotating shaft; and a second driving portion moving the cutting blade toward the work in the vertical direction perpendicular to the horizon via the unit when cutting, wherein a mounting direction of the supporting portion to the unit is generally perpendicular to a moving direction of the cutting blade, the moving direction of the cutting blade being the vertical direction to which the cutting blade is moved by the second driving portion, wherein the mounting direction extends generally perpendicular to the unit, and wherein the supporting portion includes a first supporting portion and a second supporting portion respectively supporting the two end portions, the first supporting portion being movable relative to the second supporting portion.

2. A work cutting apparatus for cutting a work by rotation of a cutting blade, comprising:

a rotating shaft mounted with the cutting blade;

a supporting portion supporting two end portions of the rotating shaft;

a unit provided in parallel to an axial direction of the rotating shaft, mounted with the supporting portion and movable in the vertical direction perpendicular to the horizon;

a first driving portion rotating the cutting blade via the rotating shaft; and a second driving portion moving the cutting blade toward the work along a normal line, perpendicular to a surface of the work, passing the point of contact between the cutting blade and the work surface via the unit when cutting, wherein a mounting direction of the supporting portion to the unit is generally perpendicular to a moving direction of the cutting blade, the moving direction of the cutting blade being the direction to which the cutting blade is moved by the second driving portion, wherein the mounting direction extends generally perpendicular to the unit, and wherein the supporting portion includes a first supporting portion and a second supporting portion respectively supporting the two end portions, the first supporting portion being movable relative to the second supporting portion.

* * * * *

UNITED STATES PATENT AND TRADEMARK OFFICE

CERTIFICATE OF CORRECTION

PATENT NO. : 6,595,094 B1
DATED : July 22, 2003
INVENTOR(S) : Kondo et al.

It is certified that error appears in the above-identified patent and that said Letters Patent is hereby corrected as shown below:

Title page, Item [54] and Column 1, lines 1 and 2,
Title, change "WORKING CUTTING APPARTUS AND METHOD FOR CUTTING WORK" to be -- WORKING CUTTING APPARATUS AND METHOD FOR CUTTING WORK --

Signed and Sealed this

Fourteenth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,595,094 B1
DATED : July 22, 2003
INVENTOR(S) : Kondo et al.

It is certified that error appears in the above-identified patent and that said Letters Patent is hereby corrected as shown below:

Title page, Item [54] and Column 1, lines 1 and 2,
Title, change "WORKING CUTTING APPARATUS AND METHOD FOR CUTTING WORK" to be -- WORK CUTTING APPARATUS AND METHOD FOR CUTTING WORK --

This certificate supersedes Certificate of Correction issued December 14, 2004.

Signed and Sealed this

Twenty-second Day of March, 2005

JON W. DUDAS
*Director of the United States Patent and Trademark Office*